US010058729B2

(12) United States Patent
Choi et al.

(10) Patent No.: US 10,058,729 B2
(45) Date of Patent: Aug. 28, 2018

(54) DEVICE FOR UPPER-LIMB REHABILITATION

(71) Applicant: Korea Institute of Science and Technology, Seoul (KR)

(72) Inventors: Jun Ho Choi, Seoul (KR); Seung-Jong Kim, Seoul (KR); Changmook Chun, Seoul (KR); Choonghyun Son, Seoul (KR); Seunghan Park, Seoul (KR); Min-Jun Choi, Seoul (KR)

(73) Assignee: Korea Institute of Science and Technology, Seoul (KR)

( * ) Notice: Subject to any disclaimer, the term of this patent is extended or adjusted under 35 U.S.C. 154(b) by 1 day.

(21) Appl. No.: 15/242,055

(22) Filed: Aug. 19, 2016

(65) Prior Publication Data

US 2017/0326405 A1 Nov. 16, 2017

(30) Foreign Application Priority Data

May 10, 2016 (KR) ..... 10-2016-0057112

(51) Int. Cl.

| | |
|---|---|
| ***A63B 23/14*** | (2006.01) |
| ***A63B 23/16*** | (2006.01) |
| ***A63B 71/00*** | (2006.01) |
| ***A61H 1/00*** | (2006.01) |
| ***A61H 1/02*** | (2006.01) |
| ***A61H 5/00*** | (2006.01) |
| ***A63B 21/00*** | (2006.01) |
| ***A63B 23/12*** | (2006.01) |

(Continued)

(52) U.S. Cl.

CPC ..... *A63B 21/4035* (2015.10); *A61H 99/00* (2013.01); *A63B 21/154* (2013.01); *A63B 23/12* (2013.01); *A63B 71/0622* (2013.01); *A61H 2205/06* (2013.01); *A61H 2205/065* (2013.01); *A63B 2071/0647* (2013.01)

(58) Field of Classification Search

CPC . A63B 21/4035; A63B 21/154; A63B 21/159; A63B 21/4041; A61H 15/0085; A61H 2205/06; A61H 2205/065; A61H 2201/1635; A61H 2201/1638

See application file for complete search history.

(56) References Cited

U.S. PATENT DOCUMENTS

| | | | | |
|---|---|---|---|---|
| 5,466,213 | A | 11/1995 | Hogan et al. | |
| 6,554,234 | B2 * | 4/2003 | Holdren | B43L 15/00 248/118.5 |
| 9,123,256 | B2 | 9/2015 | Byblow et al. | |

(Continued)

FOREIGN PATENT DOCUMENTS

| | | | |
|---|---|---|---|
| JP | 2012-35022 | A | 2/2012 |
| JP | 2016-052492 | A | 4/2016 |

(Continued)

*Primary Examiner* — Nyca T Nguyen

(74) *Attorney, Agent, or Firm* — NSIP Law

(57) ABSTRACT

A device for upper-limb rehabilitation, which assists a user in exercising the arm for rehabilitation, has a connector, a placing unit movably connected to the connector, and a driving unit configured to move the connector, wherein when a user places the arm on the placing unit and moves the placing unit, the driving unit is operated to move the connector along the placing unit, so as to enlarge a work space in which the user is capable of moving the arm.

17 Claims, 20 Drawing Sheets

(51) Int. Cl.
*A63B 71/06* (2006.01)
*A61H 99/00* (2006.01)

(56) References Cited

U.S. PATENT DOCUMENTS

2006/0106326 A1* 5/2006 Krebs ..... A61H 1/0274 601/40
2006/0116260 A1* 6/2006 Zeng ..... A63B 21/0004 482/139
2007/0043308 A1 2/2007 Lee
2007/0282228 A1* 12/2007 Einav ..... A61B 5/7475 601/33
2011/0021955 A1* 1/2011 Byblow ..... A61H 1/0274 601/5
2011/0300994 A1* 12/2011 Verkaaik ..... A61H 1/0274 482/51
2014/0336542 A1* 11/2014 Fu ..... A61H 1/0281 601/5
2016/0000633 A1* 1/2016 An ..... A61H 1/02 601/33
2016/0082605 A1* 3/2016 Marks ..... B26B 7/00 30/355
2016/0271438 A1* 9/2016 Weisz ..... A61H 1/0274
2016/0367428 A1* 12/2016 Townsend ..... A61H 1/0237

FOREIGN PATENT DOCUMENTS

KR 10-2006-0001831 A 1/2006
KR 10-2005-0121049 A 12/2006
KR 10-2011-0027447 A 3/2011
KR 10-2011-0074170 A 6/2011
KR 10-2012-0015704 A 6/2013
KR 10-1317817 B1 10/2013
KR 10-2014-0081461 A 7/2014
KR 10-2014-0081461 A 11/2014
KR 10-2015-0082711 A 6/2015
KR 10-2015-0082711 A 7/2015
KR 10-2014-0084691 B1 9/2015

* cited by examiner

DEVICE FOR UPPER-LIMB REHABILITATION

CROSS-REFERENCE TO RELATED APPLICATION

This application claims priority to Korean Patent Application No. 10-2016-0057112, filed on May 10, 2016, and all the benefits accruing therefrom under 35 U.S.C. § 119, the contents of which in its entirety are herein incorporated by reference.

BACKGROUND

1. Field

The present disclosure relates to a device for upper-limb rehabilitation, and more particularly, to a device for upper-limb rehabilitation which helps rehabilitation by assisting in upper-limb exercise of a rehabilitator, the old or the infirm.

2. Description of the Related Art

When upper-limb muscular strength of the old or the infirm is weakened due to an old age or a patient loses his/her muscular strength due to an accident or a stroke, a device for upper-limb rehabilitation is used as rehabilitation equipment for reinforcing the muscular strength.

In particular, when a stroke patient makes an exercise for the arm, a better rehabilitation effect may be obtained if the influence by his/her weight is eliminated.

However, an existing device for upper-limb rehabilitation generally has an exoskeleton surrounding the arm to assist in reinforcing the muscular strength, but this device gives a burden due to its weight.

In addition, in an existing technique, it is required for the patient to put the arm into the device or wear the device around the arm, which however takes a long time. In addition, it is difficult to manipulate the device so that a rotary axis of the device is matched with a rotary axis of a human joint, which gives an inconvenience to the user and may not allow the user to smoothly use the device.

There has been attempted to minimize the influence of a weight of a device by suitably adding links and motors to a general exercise device, other than a wearing-type device, so that a user may make a rehabilitation exercise just after placing the device on the arm.

However, since the old or a patient suffers from inconvenient body movements and has a weakened muscular strength, it is very difficult to perform rehabilitation training while overcoming an inertia caused by the weight of the corresponding device.

SUMMARY

The present disclosure is directed to providing a device for upper-limb rehabilitation, which may minimize a force required for operating the device for upper-limb rehabilitation and maximize a work space for a user to perform behaviors required for upper-limb rehabilitation, thereby giving very efficient upper-limb rehabilitation effects.

In one aspect of the present disclosure, there is provided a device for upper-limb rehabilitation, which assists a user in exercising the arm for rehabilitation, the device comprising: a connector; a placing unit movably connected to the connector; and a driving unit configured to move the connector, wherein when a user places the arm on the placing unit and moves the placing unit, the driving unit is operated to move the connector along the placing unit, so as to enlarge a work space in which the user is capable of moving the arm.

According to an embodiment, the driving unit may be operated when the placing unit deviates from a reference location defined with respect to the connector, and move the connector so that the placing unit is placed at the reference location.

According to an embodiment, a movement area in which the placing unit is movable with respect to the connector may be defined, and when the placing unit moves beyond the movement area, the driving unit may move the connector so that the placing unit is located in the movement area.

According to an embodiment, when the placing unit rotates based on a center of the placing unit, the driving unit may move the connector so that the connector rotates based on a center of the connector.

According to an embodiment, the connector may include: a connection body connected to the driving unit; a connection bunch connected to the placing unit; a first link unit configured to fix the connection bunch to be movable with respect to the connection body; and a plurality of angle sensors configured to measure rotation angles of links of the first link unit and provide information about rotation and horizontal movement of the connection bunch.

According to an embodiment, the connector may include a brake unit which interferes in the operation of the first link unit to adjust a force required for a user to move the placing unit.

According to an embodiment, the first link unit may include a first connection link body and a second connection link body connected to different portions of the connection bunch to form a closed-loop structure between the connection bunch and the connection body.

According to an embodiment, the angle sensor may be provided at a connection portion of the first connection link body and the second connection link body, which is connected to the connection body.

According to an embodiment, the driving unit may include: a driving bunch coupled to the connector; a second link unit configured to move the driving bunch horizontally; and a third link unit configured to rotate the driving bunch.

According to an embodiment, the second link unit and the third link unit may be formed to be coupled to each other and be independently controlled to horizontally move or rotate the driving bunch independently.

According to an embodiment, the second link unit may include first to fourth horizontal movement links, the first to fourth horizontal movement links may be connected to form a closed-loop structure and thus defines first to fourth basic rotary shafts on which the first to fourth horizontal movement links rotate relative to each other, and the driving bunch may be formed at a connection portion of the second horizontal movement link and the third horizontal movement link, which define the first basic rotary shaft, to horizontally move according to relative rotations of the first to fourth horizontal movement links.

According to an embodiment, the device for upper-limb rehabilitation may comprise a first motor and a second motor configured to rotate the first horizontal movement link and the fourth horizontal movement link, which are formed to be rotatable based on the fourth basic rotary shaft facing the first basic rotary shaft, with respect to the fourth basic rotary shaft.

According to an embodiment, the third link unit may include: first to fourth rotation links; and first to fourth rotation cams configured to be rotatable based on centers of the first to fourth basic rotary shafts, respectively, wherein the first to fourth rotation links are connected with the first to fourth rotation cams being interposed therebetween to form a closed-loop structure, and wherein the driving bunch is coupled to the first rotation cam to rotate based on the center of the first basic rotary shaft according to the rotation of the first rotation cam.

According to an embodiment, the device for upper-limb rehabilitation may comprise a third motor configured to rotate the fourth rotation cam based on the center of the fourth basic rotary shaft facing the first rotation cam, and the first rotation cam may rotate based on the first basic rotary shaft by means of successive operations of the first to fourth rotation links according to the rotation of the fourth rotation cam.

According to an embodiment, the device for upper-limb rehabilitation may fix a location of the placing unit with respect to the connector, and the driving unit may be operated to move the connector so as to move the arm of the user.

According to an embodiment, the device for upper-limb rehabilitation may further comprise a display unit configured to visually display a moving situation of the placing unit to the user.

According to an embodiment, the device for upper-limb rehabilitation may demonstrate a rehabilitation program for designating a moving path of the placing unit through the display unit.

DETAILED DESCRIPTION

Figure 1:
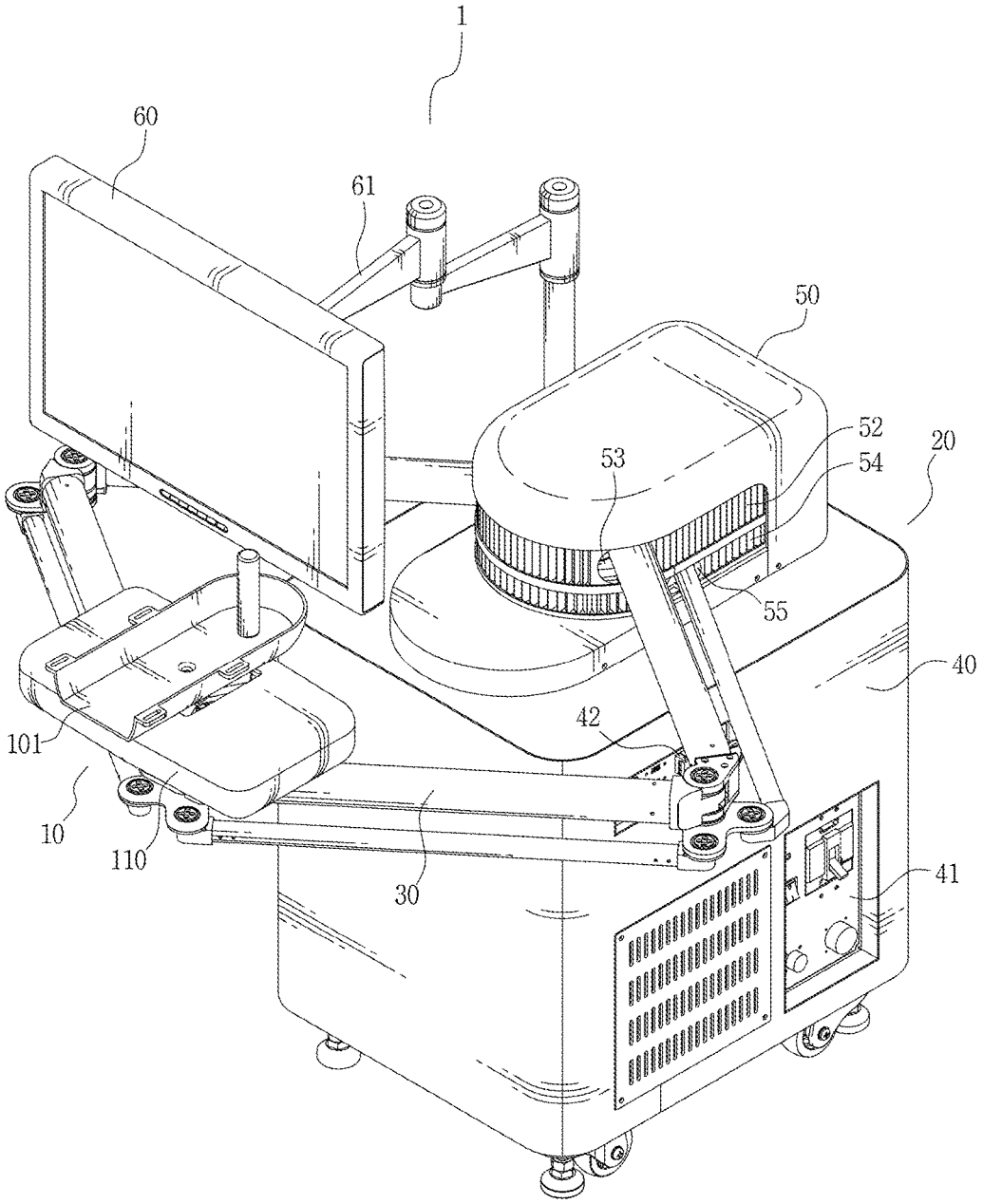
FIG. 1 is a perspective view showing a device for upper-limb rehabilitation according to an embodiment of the present disclosure.

Hereinafter, embodiments of the present disclosure will be described with reference to the accompanying drawings. Even though the present disclosure is described based on the embodiments depicted in the drawings, the embodiments are just examples, and the technical features and the essential configurations and operations of the present disclosure are not limited thereto.

Figure 2:
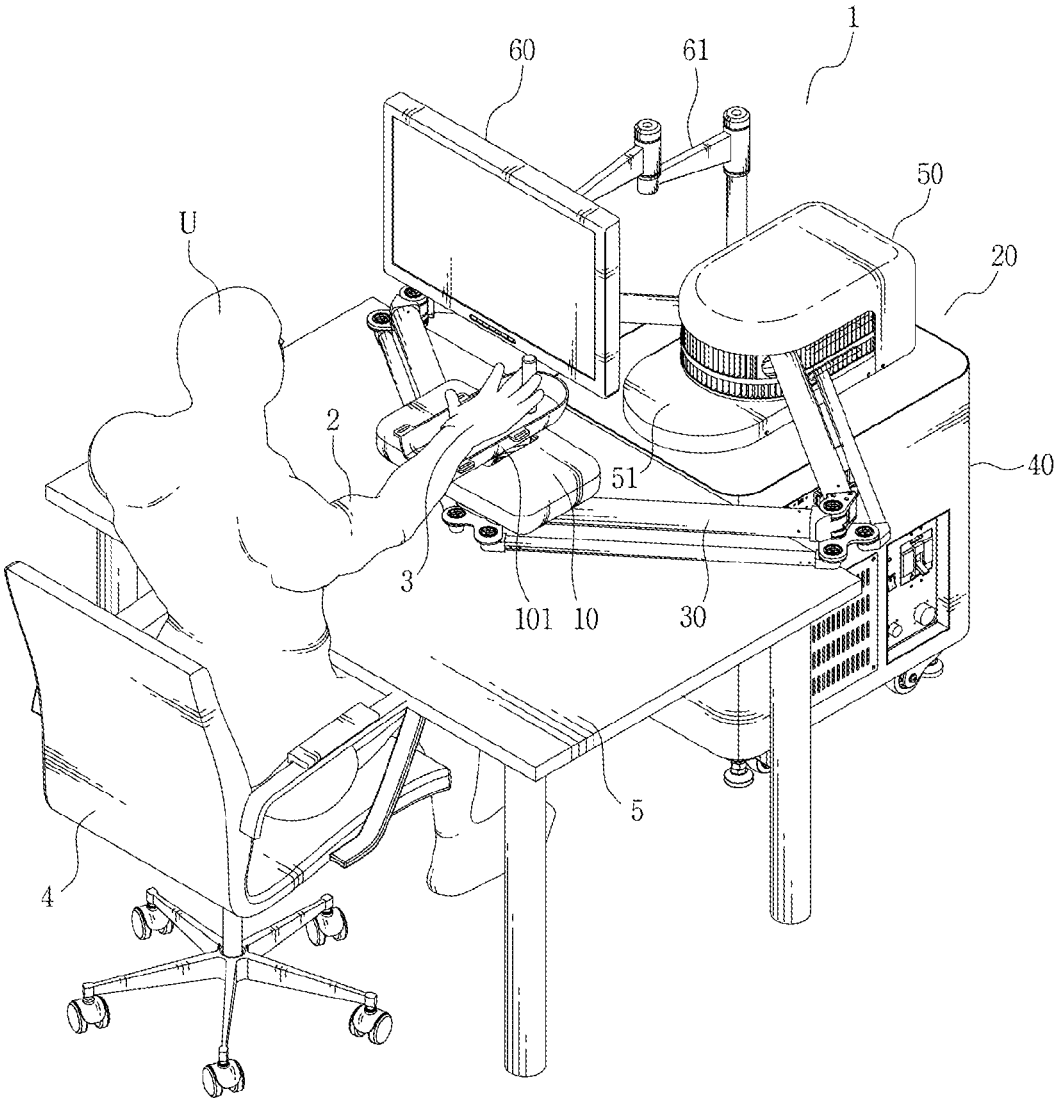
FIG. 2 is a diagram showing a service condition of the device for upper-limb rehabilitation depicted in FIG. 1.

FIG. 1 is a perspective view showing a device 1 for upper-limb rehabilitation according to an embodiment of the present disclosure, and FIG. 2 is a diagram showing a service condition of the device 1 for upper-limb rehabilitation.

As shown in FIGS. 1 and 2, the device 1 for upper-limb rehabilitation includes an arm holder 10 on which a user U places the arm 2, a main body 20 placed on the ground, and a driving unit 30 for connecting the arm holder 10 to the main body 20.

The main body 20 includes a box-shaped body 40, and at a side of the body 40, a terminal 42 for connecting a power source or the like and a control unit 41 for turning on or off the driving unit 30 or inputting a control value are provided. In the body 40, a computing unit for computing and storing a location of the connection bunch 130 and a controller for driving a motor may also be included.

On the body 40, a cap 50 is provided so that the motor of the driving unit 30 or the like is not exposed outwards.

At the front of the cap 50, slits 53, 55 elongating in a direction parallel to the ground are formed so that a link of the driving unit 30 may move in a direction parallel to the ground.

Covers 52, 54 are formed at the slits 53, 55 to cover the openings of the slits 53, 55, and the covers 52, 54 are folded like an accordion to change its length at each part so as not to interfere movement of the link of the driving unit 30.

A fixing unit 61 is installed at one side of the upper portion of the body 40, and a display unit 60 is coupled to the fixing unit 61. The display unit 60 and the fixing unit 61 are detachably mounted to the main body 20.

The fixing unit 61 may be adjusted so that the display unit 60 may be easily watched by the user.

One side of the driving unit 30 is connected to the main body 20, and the other side of the driving unit 30 is connected to the arm holder 10.

As well shown in FIG. 2, the user U may perform upper-limb rehabilitation training in a state of seating on a chair 4 so that the user U may watch the display unit 60 while facing the main body 20. If necessary, a table 5 on which the user U may lean may be placed between the user U and the main body 2.

Figure 3:
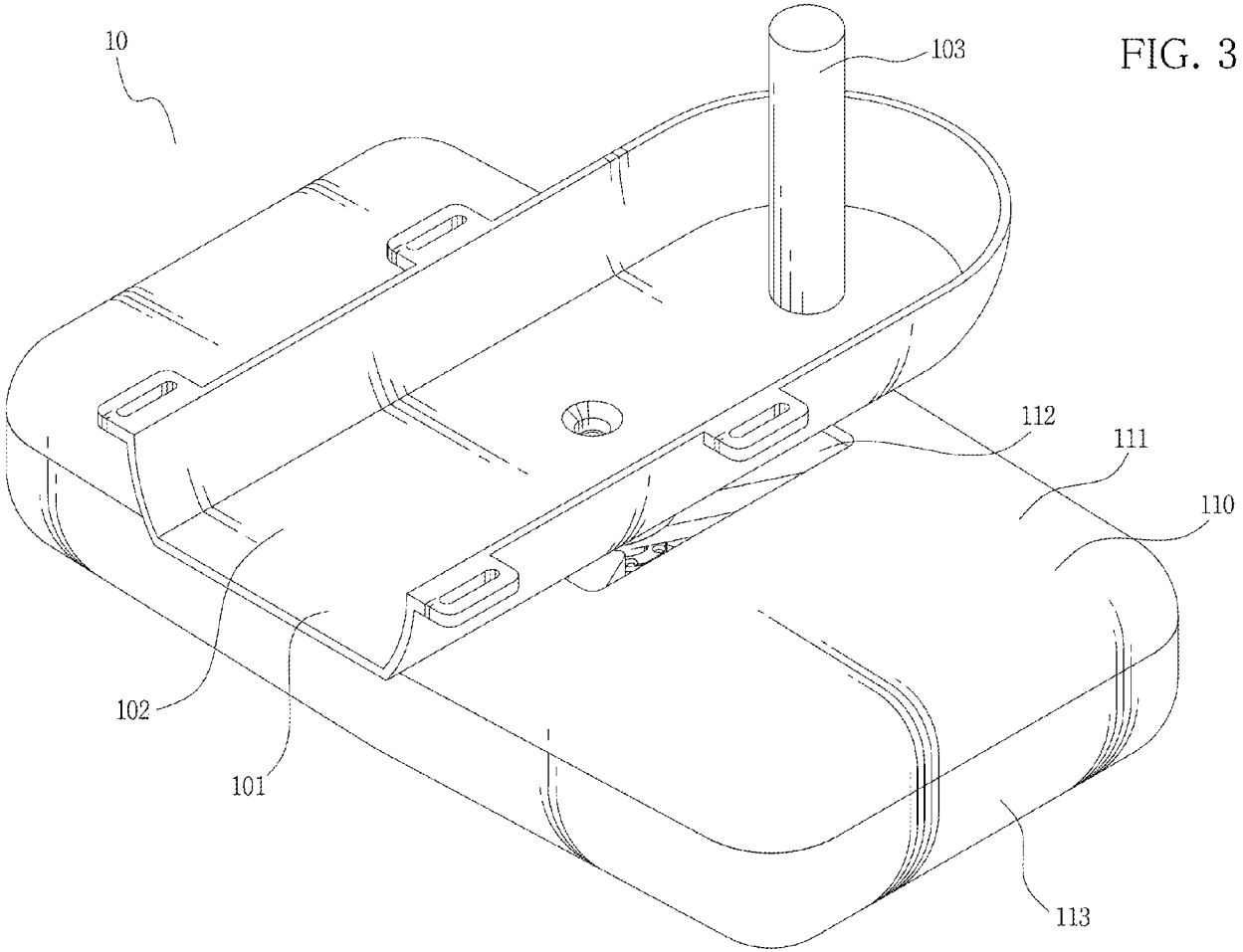
FIG. 3 is an enlarged view showing an arm holder, employed in the device for upper-limb rehabilitation depicted in FIG. 1.
Figure 4:
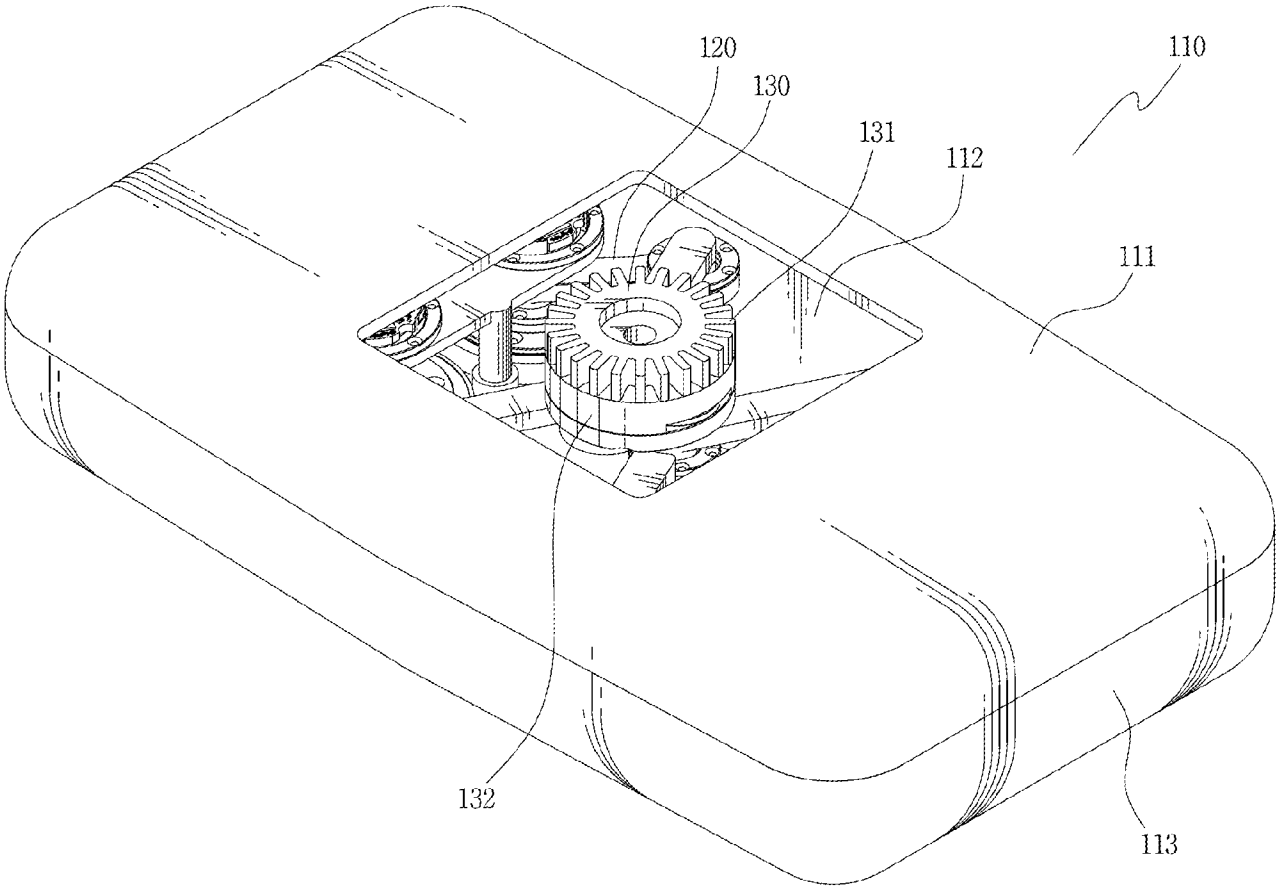
FIG. 4 is a diagram showing that a placing unit is removed from the arm holder of FIG. 3.

FIG. 3 is an enlarged view showing an arm holder 10, employed in the device 1 for upper-limb rehabilitation, and FIG. 4 is a diagram showing that a placing unit 101 is removed from the arm holder 10.

As shown in FIGS. 3 and 4, the arm holder 10 includes a connector 110, and a placing unit 101 located on the connector 110.

The connector 110 includes a lower connection body 113 and an upper connection body 111 which are connected vertically to form a box shape with an inner space. A through hole 112 is formed at a center of the upper portion of the upper connection body 111.

Referring to FIG. 4, a connection bunch 130 and a first link unit 120 are located in the connection bodies 111, 113. The connection bunch 130 is exposed outwards through the through hole 112. As shown in FIG. 3, the connection bunch 130 is connected to the placing unit 101.

The placing unit 101 includes a fixing plate 102 (see FIG. 2) on which the user U may place the hand 3, and a gripping rod 103 extending substantially vertically at an end of the fixing plate 102 so that the user U may grip with the hand 3.

If the user U is able to grip any article by using the hand 3, the user may perform upper-limb rehabilitation training in a state of gripping the gripping rod 103, but if the user U is not able to use the hand 3, a band may be coupled to the slits formed at both sides of the fixing plate 102 so that the hand 3 is tied to the placing unit 101.

Figure 5:
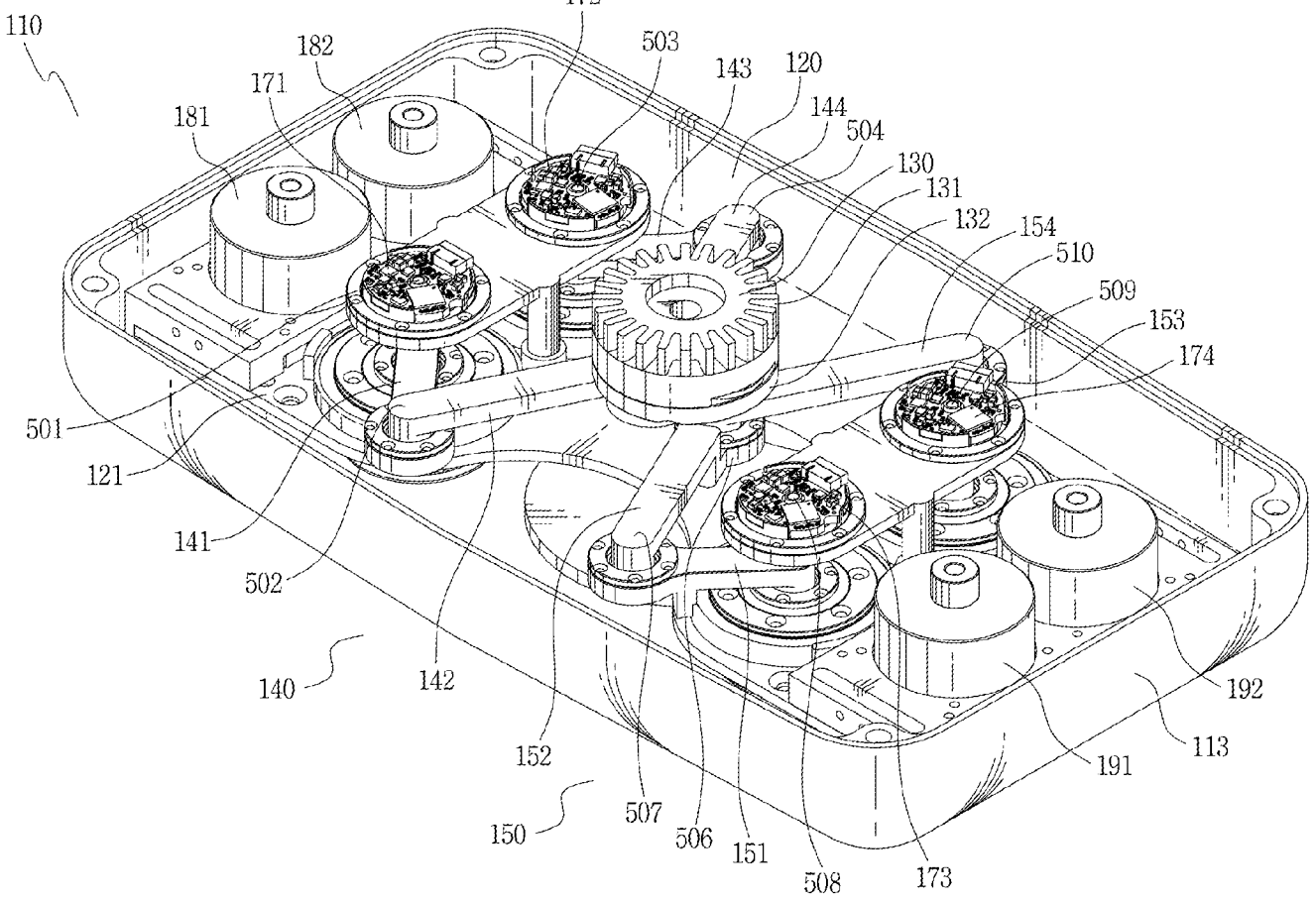
FIG. 5 is a diagram showing that an upper connection body is removed from a connector depicted in FIG. 4.

FIG. 5 is a diagram showing that an upper connection body 111 is removed from the connector 110.

As shown in FIG. 5, the lower connection body 113 includes an inner connection body 121 having approximately a sandglass shape and formed along the length direction of the lower connection body 113.

In the specification, for convenience, the upper connection body 111, the lower connection body 113 and the inner connection body 121 are distinguishably explained, but they forms a single fixed structure and thus may be called a "connection body" in general.

The first link unit 120 is movably formed at the inner connection body 121, and the connection bunch 130 is connected to the first link unit 120.

The connection bunch 130 includes an upper bunch 131 coupled to the placing unit 101 and a lower bunch 132 coupled to the first link unit 120.

The connection bunch 130 is divided into two parts, namely the upper bunch 131 and the lower bunch 132, but the upper bunch 131 and the lower bunch 132 are coupled to each other not to move relative to each other.

Figure 6:
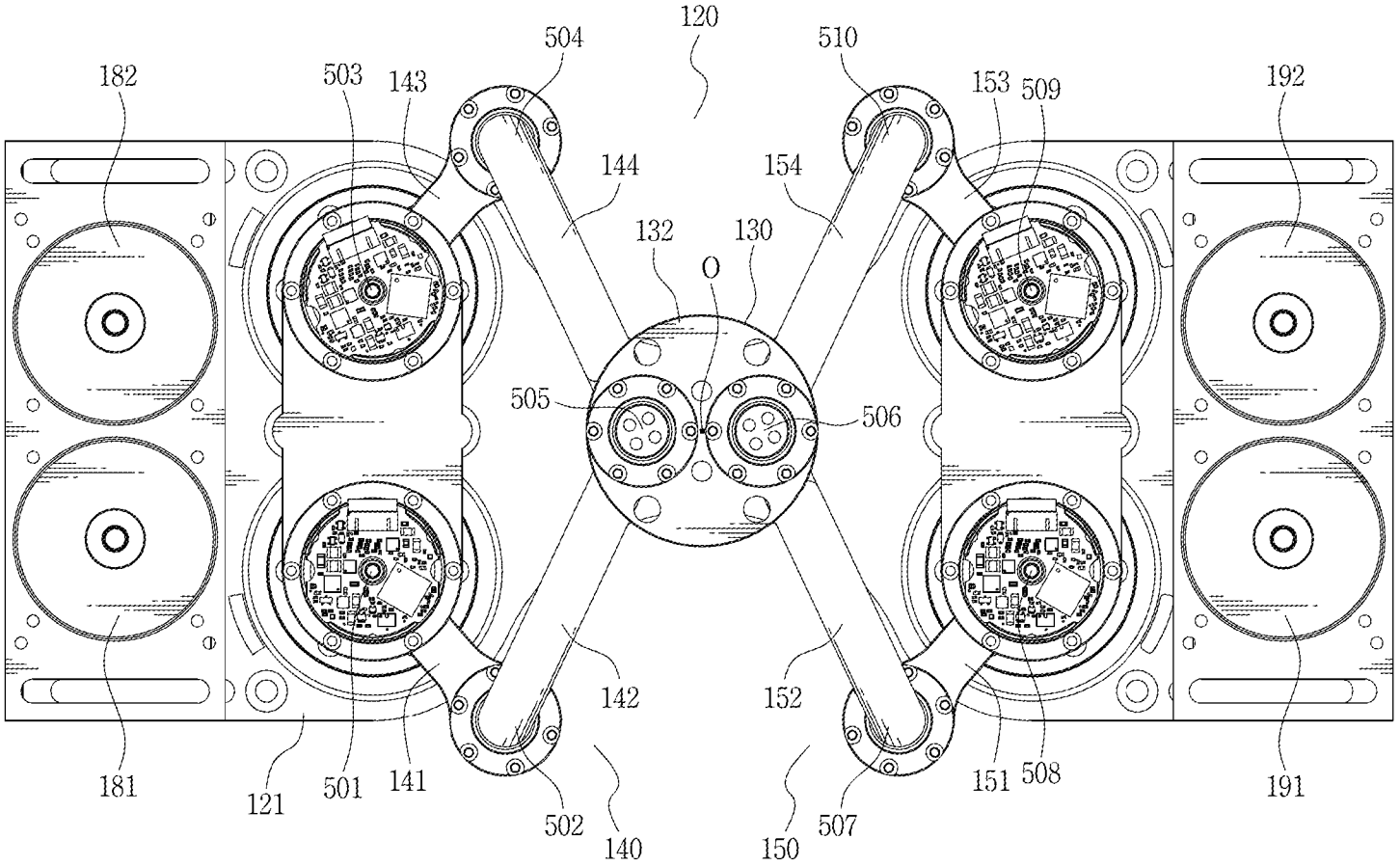
FIG. 6 is a diagram showing that a lower connection body is removed from the connector of FIG. 5, observed from the above.

FIG. 6 is a diagram showing that a lower connection body 113 is removed, observed from the above. In FIG. 6, the upper bunch 131 is not depicted.

As shown in FIG. 6, the first link unit 120 includes a first connection link body 140 and a second connection link body 150 symmetrically formed based on the connection bunch 130.

The first connection link body 140 is a four-node link body including first to fourth connection links 141, 142, 143, 144.

The first connection link 141 is connected to the inner connection body 121 so that its one end is rotatable based on the first rotary shaft 501, and the other end of the first connection link 141 is rotatably connected to the second connection link 142. The second connection link 142 is connected to the first connection link 141 so that its one end is rotatable based on the second rotary shaft 502, and the other end of the second connection link 142 is connected to the lower bunch 132 to be rotatable based on the fifth rotary shaft 505.

The third connection link 143 is connected to the inner connection body 121 so that its one end is rotatable based on the third rotary shaft 503, and the other end of the third connection link 143 is rotatably connected to the fourth connection link 144. The fourth connection link 144 is connected to the third connection link 143 so that its one end is rotatable based on the fourth rotary shaft 504, and the other end of the fourth connection link 144 is connected to the lower bunch 132 to be rotatable based on the fifth rotary shaft 505.

By doing so, the first connection link body 140 forms a closed-loop structure between the connection bunch 130 and the connection body, and an operation of any one connection link gives an influence to the operation of another connection link.

The second connection link body 150 is a four-node link body including fifth to eighth connection links 151, 152, 153, 154.

The fifth connection link 151 is connected to the inner connection body 121 so that its one end is rotatable based on the eighth rotary shaft 508, and the other end of the fifth connection link 151 is rotatably connected to the sixth connection link 152. The sixth connection link 152 is connected to the fifth connection link 151 so that its one end is rotatable based on the seventh rotary shaft 507, and the other end of the sixth connection link 152 is connected to the lower bunch 132 to be rotatable based on the sixth rotary shaft 506. The fifth rotary shaft 505 and the sixth rotary shaft 506 formed at the lower bunch 132 are symmetrical to each other based on the center O of the lower bunch (namely, the center of the connection bunch).

The seventh connection link 153 is connected to the inner connection body 121 so that its one end is rotatable based on the ninth rotary shaft 509, and the other end of the seventh connection link 153 is rotatably connected to the eighth connection link 154. The eighth connection link 154 is connected to the seventh connection link 153 so that its one end is rotatable based on the tenth rotary shaft 510, and the other end of the eighth connection link 154 is connected to the lower bunch 132 to be rotatable based on the sixth rotary shaft 506.

By doing so, the second connection link body 150 forms a closed-loop structure between the connection bunch 130 and the connection body, and an operation of any one connection link gives an influence on the operation of another connection link.

In this configuration, the connection bunch 130 is fixed by the first link unit 120 to be movable with respect to the inner connection body 121.

Figure 7:
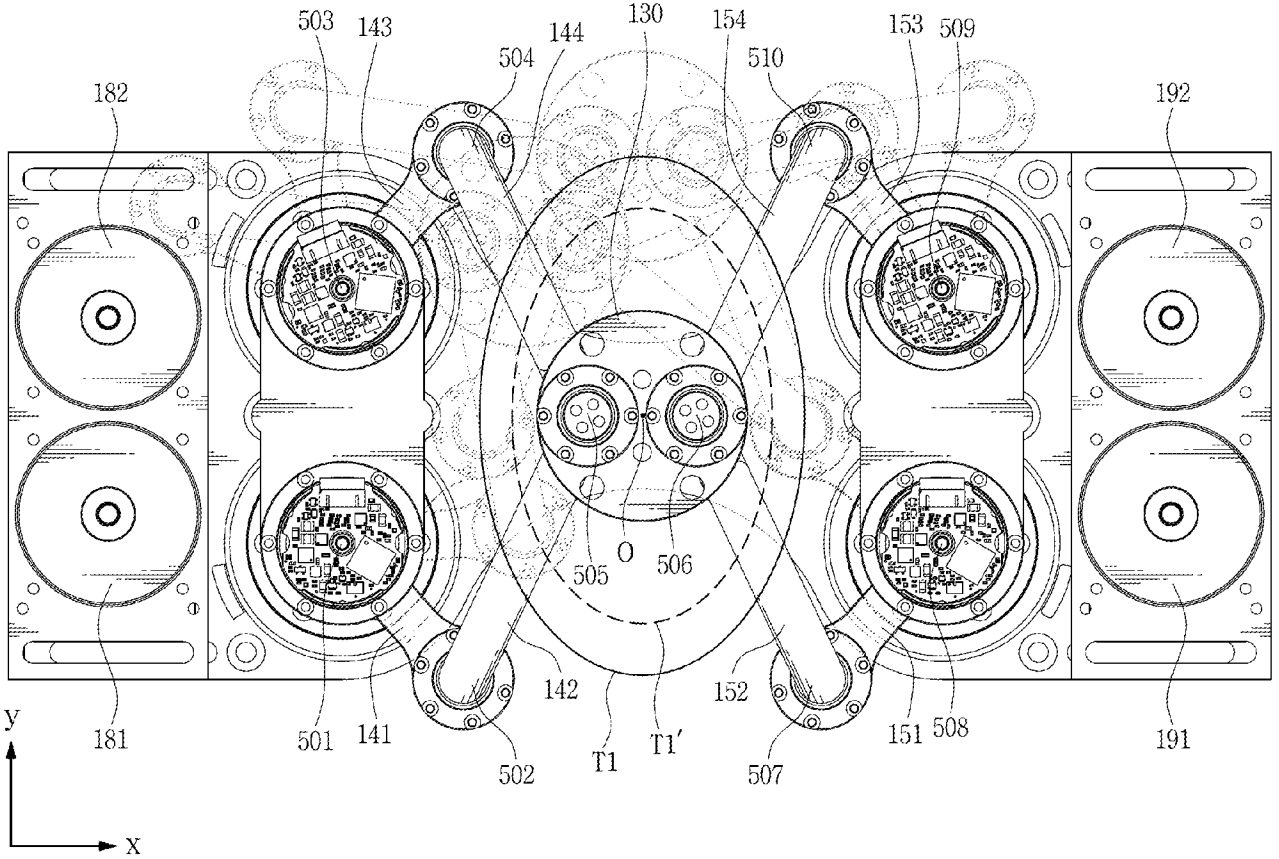
FIGS. 7 and 8 are diagrams showing that a connection bunch moves with respect to an inner connection body.
Figure 8:
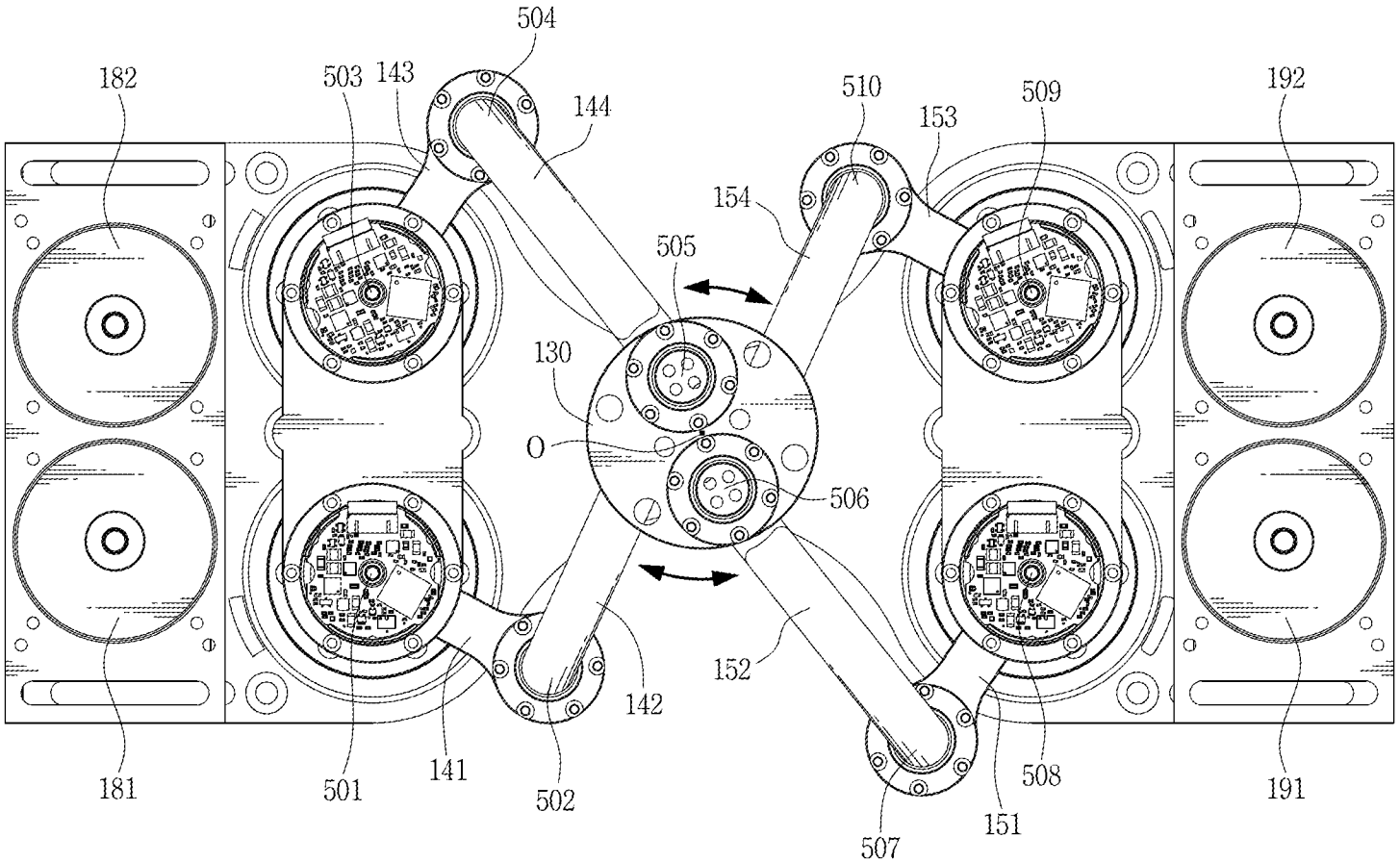

FIGS. 7 and 8 are diagrams showing that the connection bunch 130 moves with respect to the inner connection body 121.

As shown with a dotted line in FIG. 7, since each of the links of the first connection link body 140 and the second connection link body 150 of the first link unit 120 rotates based on a rotary shaft associated therewith, the link may freely move horizontally within a predetermined area T1 formed at the center of the inner connection body 121.

Meanwhile, as shown in FIG. 8, since the fifth rotary shaft 505 and the sixth rotary shaft 506 are arranged symmetrically based on the center O of the connection bunch 130 and also the first connection link body 140 and the second connection link body 150 are formed symmetrically, the connection bunch 130 may also rotate (in an arrow direction) based on the center O without horizontally moving.

In other words, the connection bunch 130 is formed to freely rotate or horizontally move with respect to the inner connection body 121. Since the inner connection body 121 is a part of the connector 110, the connection bunch 130 may horizontally move or rotate relative to the connector 110.

In addition, as described above, the connection bunch 130 and the placing unit 101 are coupled and fixed to each other. Therefore, the placing unit 101 may horizontally move or rotate with respect to the connector 110 by means of the connection bunch 130. The "center of the placing unit 101" around which the placing unit 101 rotates may be the center O of the connection bunch 130.

In this embodiment, a plurality of links of the first connection link body 140 and the second connection link body 150 are connected by means of a passive joint which is not associated with a driving unit.

Therefore, as long as a brake is not operated, the first connection link body 140 and the second connection link body 150 may smoothly move just with a very small force. Therefore, the user U may horizontally move and/or rotate the placing unit 101 by moving the arm while feeling substantially no resistance against the first link unit 120.

Meanwhile, referring to FIG. 5 again, in this embodiment, a plurality of angle sensors (encoders) 171, 172, 173, 174 is provided to measure rotation angles of the links of the first link unit 120 and provide information about horizontal movement and rotation of the connection bunch 130.

In this embodiment, four angle sensors 171, 172, 173, 174 are provided at connection portions of the first connection link body 140 and the second connection link body 150, which are connected to the inner connection body.

The first angle sensor 171 measures a rotation angle of the first connection link 141 with respect to the first rotary shaft 501, and the second angle sensor 172 measures a rotation angle of the third connection link 143 with respect to the third rotary shaft 503. The third angle sensor 173 measures a rotation angle of the fifth connection link 151 with respect to the eighth rotary shaft 508, and the fourth angle sensor 174 measures a rotation angle of the seventh connection link 153 with respect to the ninth rotary shaft 509.

Since the first connection link body 140 and the second connection link body 150 forms a closed-loop structure between the connection bunch 130 and the connection body, if any one connection link is positioned, locations of other connection links may also be computed by means of kinetic relations thereof.

Therefore, based on the rotation angles of four connection links 141, 143, 151, 153 detected by the four angle sensors 171, 172, 173, 174, rotation angles of all connection links of the first connection link body 140 and the second connection link body 150 may be computed, and by using the same, a current location and rotation angle of the connection bunch 130 at the inner connection body 121 may be computed.

According to this embodiment, the four angle sensors 171, 172, 173, 174 may measure an angular speed and an angular acceleration of a connection link connected thereto, in addition to the rotation angle, and a moving speed and acceleration of the connection bunch 130 may also be computed therefrom.

Figure 9:
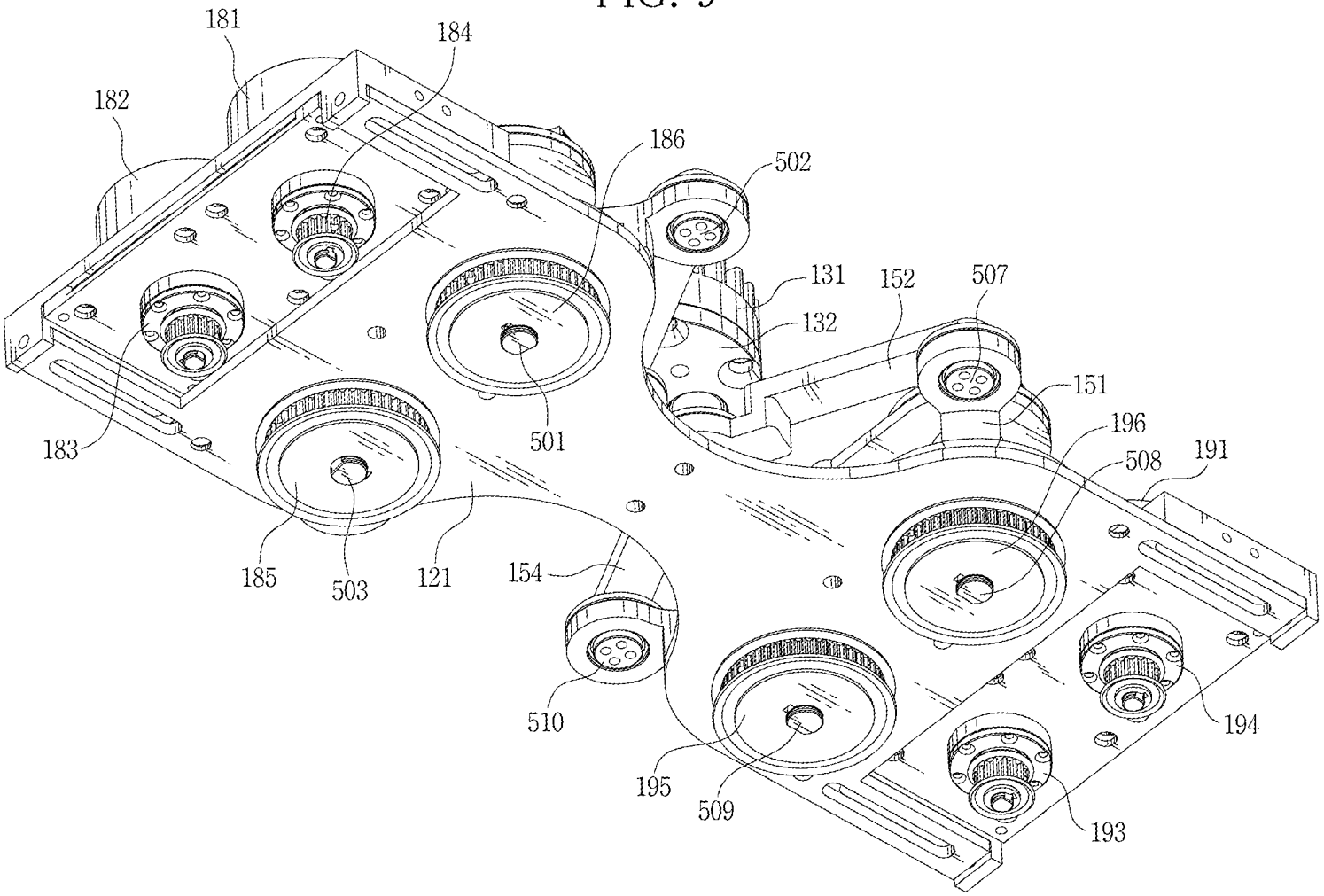
FIG. 9 is a perspective rear view showing a connector depicted in FIG. 8.

FIG. 9 is a perspective rear view showing the connector depicted in FIG. 8.

As shown in FIG. 9, four pulleys 185, 186, 195, 196 are installed at a rear surface of the inner connection body 121. The first pulley 185 is connected to the first connection link 141 to rotate together with the first connection link 141, and the second pulley 186 is connected to the third connection link 143 to rotate together with the third connection link 143. The third pulley 196 is connected to the fifth connection link 151 to rotate together with the fifth connection link 151, and the fourth pulley 195 is connected to the seventh connection link 153 to rotate together with the seventh connection link 153.

Four brake units 181, 182, 191, 192 are provided at the top surface of the inner connection body 121. Four pulleys 183, 184, 193, 194 respectively connected to the brake units 181, 182, 191, 192 are formed at the rear surface of the inner connection body 121.

The brake units 181, 182, 191, 192 may give resistance to the four pulleys 183, 184, 193, 194 connected thereto by using an electric or mechanical configuration to control rotational inertia thereof.

Though not shown in the figures, the fifth pulley 183 and the first pulley 185 are connected using a timing belt.

Therefore, if a predetermined impedance is applied to the fifth pulley 183 by means of the brake unit 182 so that the fifth pulley 183 does not rotate perfectly freely but rotates with predetermined resistance, the rotational inertia of the fifth pulley 183 is transferred to the first pulley 185 so that the first pulley 185 also rotates with predetermined resistance.

Similarly, a timing belt is also connected between a pulley connected to the brake unit and a pulley facing the former pulley and connected to the connection link, and each brake unit has predetermined resistance to pulleys operatively connected thereto.

Due to the inference of the brake units 181, 182, 191, 192, the first connection link 141, the third connection link 143, the fifth connection link 151 and the seventh connection link 153 rotate with predetermined resistance, and as a result, the operation of the entire first link unit 120 is interfered. Therefore, the moving bunch 130 has predetermined movement inertia, and the user U feels a force of a predetermined intensity when moving the placing unit 101 connected to the moving bunch 130.

The movement inertia of the placing unit 101 may be adjusted depending on a muscular strength situation of the user U or a training program. Further, the first link unit 120 may be entirely bound by means of the brake unit, so that the placing unit 101 does not move with respect to the connector 110 but is fixed.

As described above, the user may perform rehabilitation training by horizontally moving and/or rotating the placing unit 101, while feeling substantially no inertia when moving the arm. However, as shown in FIG. 7, a movement area of the placing unit 101 with respect to the connector 110 is restricted to be a relatively small area. If the movement area of the placing unit 101 is restricted as a small area as shown in FIG. 7, the user may not move the shoulder much.

In order to compensate this, in this embodiment, a driving unit 30 for moving a location of the connector 110 is provided. If the user places the arm on the placing unit 101 and moves the placing unit 101, the driving unit 30 is operated by detecting the movement and moves the connector 110 along the placing unit 101. By doing so, a work space in which the user is able to move the arm may be enlarged.

Figure 10:
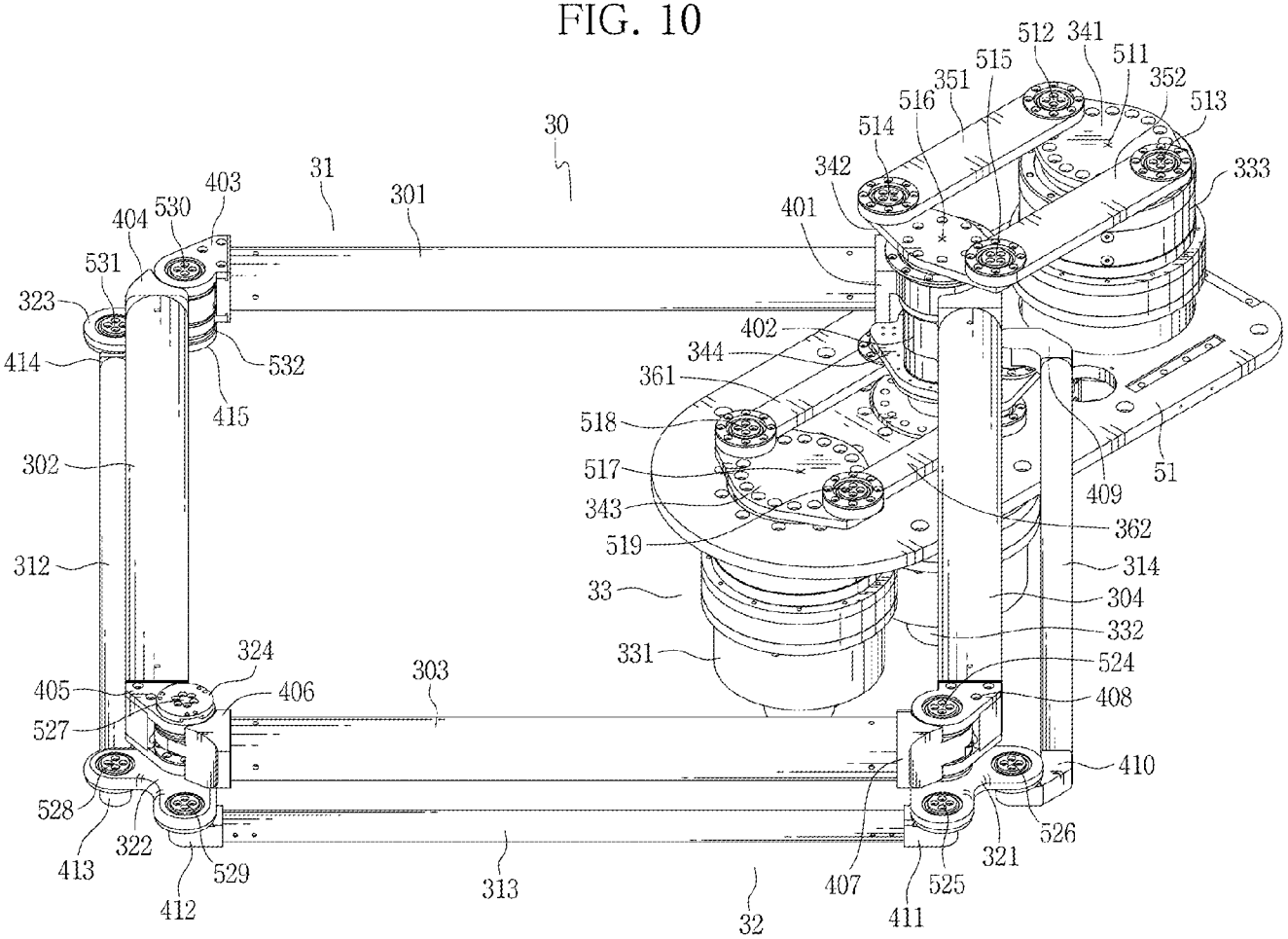
FIG. 10 is a perspective view showing a driving unit, employed in the device for upper-limb rehabilitation depicted in FIG. 1.
Figure 11:
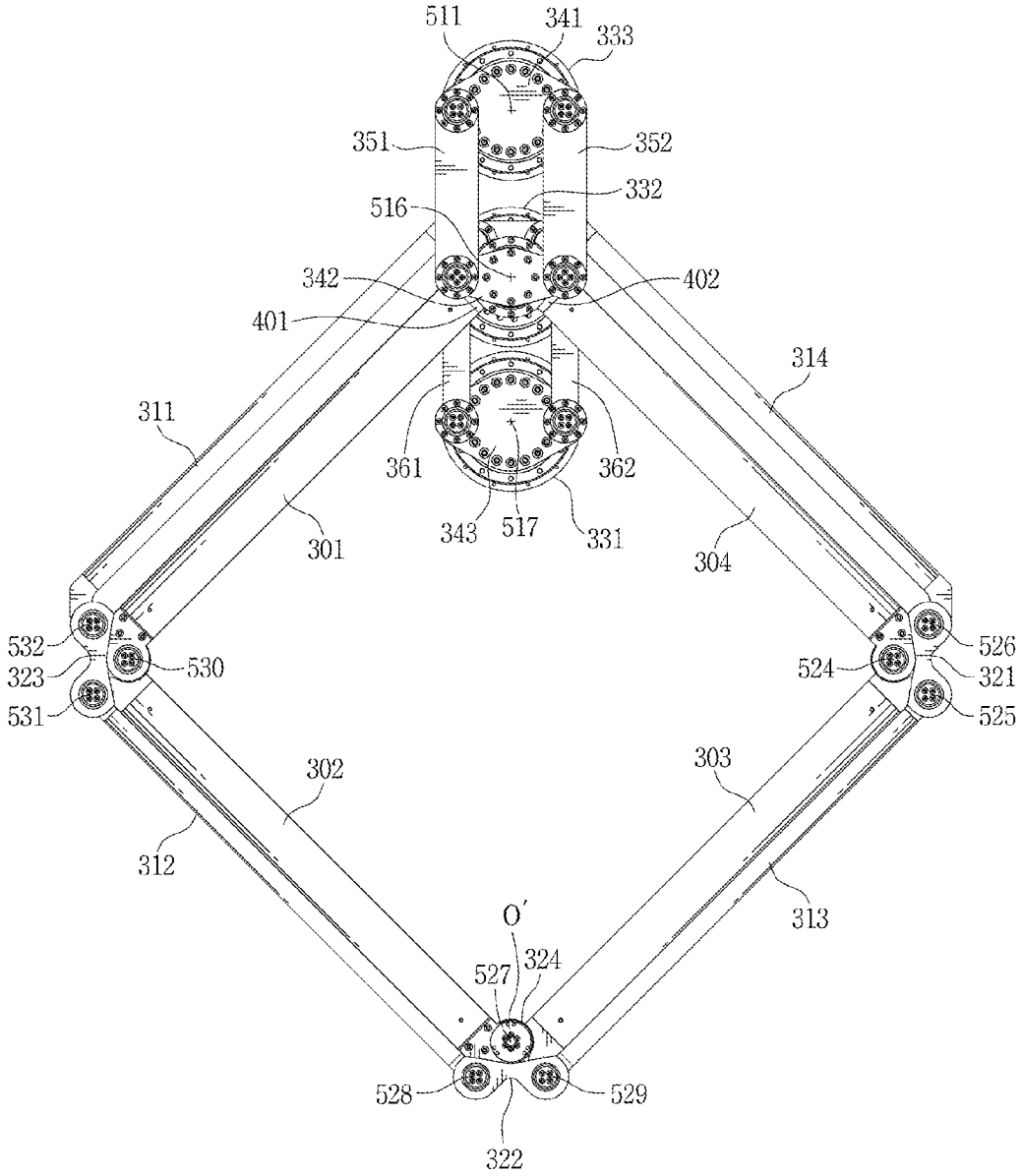
FIG. 11 is a plane view showing the driving unit of FIG. 10.

FIG. 10 is a perspective view showing the driving unit 30 according to an embodiment of the present disclosure, and FIG. 11 is a plane view showing the driving unit 30.

As shown in FIGS. 10 and 11, the driving unit 30 includes a driving bunch 324, a second link unit 31 configured to horizontally move the driving bunch 324, a third link unit 32 configured to rotate the driving bunch 324 based on its central axis O', and a driving portion 33 configured to operate the second link unit 31 and the third link unit 32.

The driving bunch 324 is fixedly coupled to the connector 110.

Figure 12:
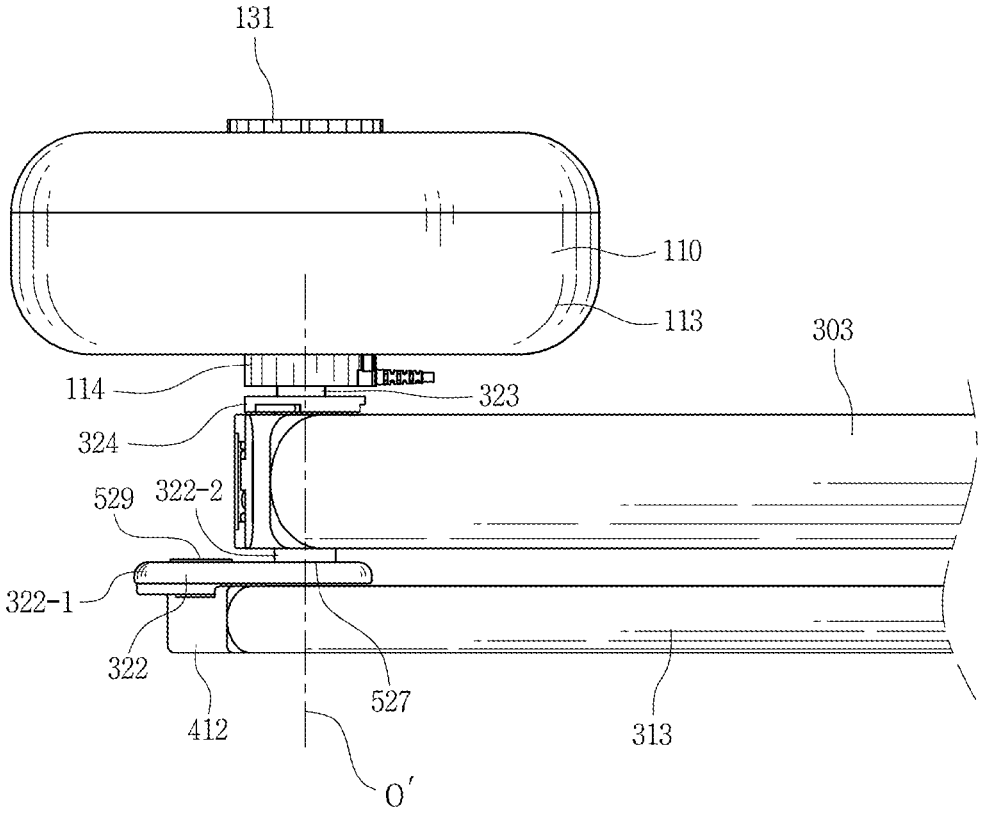
FIG. 12 is a diagram showing that a driving bunch is coupled with the connector.

FIG. 12 is a diagram showing that the driving bunch 324 is coupled with the connector 110.

As shown in FIG. 12, a fixed shaft 323 is inserted into the top end of the driving bunch 324 and fixed thereto. A joining bunch 114 is formed at a lower end of the lower connection body 113 of the connector 110, and the fixed shaft 323 is inserted into and fixed to the joining bunch 114, thereby fixing the driving bunch 324 to the connector 110.

The joining bunch 114 is disposed at the center of the lower connection body 113, so that the center of the lower connection body 113 is located on the same axis as the center O' of the driving bunch 324.

If the driving bunch 324 rotates based on the center O', the connector 110 rotates based on the center O', and if the driving bunch 324 horizontally moves, the connector 110 also moves horizontally.

Referring to FIGS. 10 and 11 again, the second link unit 31 includes first to fourth horizontal movement links 301, 302, 303, 304 which form a rectangular closed-loop structure.

The first horizontal movement link 301 includes a first connection 401 at one end thereof and a third connection 403 at the other end thereof.

The first connection 401 is connected to be freely rotatable with respect to a motor shaft 334 (see FIG. 14) of a second motor 332 which rotates based on a $16^{th}$ rotary shaft ("a fourth basic rotary shaft") 516. The first horizontal movement link 31 is formed to be rotatable based on the $16^{th}$ rotary shaft 516.

The third connection 403 is coupled to a fourth connection 404 formed at one end of the second horizontal movement link 302. The fourth connection 404 is connected to be rotatable with respect to the third connection 403 based on a $30^{th}$ rotary shaft ("a third basic rotary shaft") 530. Therefore, the second horizontal movement link 302 is rotatable with respect to the first horizontal movement link 301 based on the $30^{th}$ rotary shaft 530.

A fifth connection 405 is formed at the other end of the second horizontal movement link 302, and the fifth connection 405 is coupled to a sixth connection 406 formed at one end of the third horizontal movement link 303. The sixth connection 406 is connected to be rotatable with respect to the fifth connection 405 based on a $27^{th}$ rotary shaft ("a first basic rotary shaft") 527. Therefore, the third horizontal movement link 303 is rotatable with respect to the second horizontal movement link 302 based on the $27^{th}$ rotary shaft 527.

A seventh connection 407 is formed at the other end of the third horizontal movement link 303, and the seventh connection 407 is coupled to an eighth connection 408 formed at one end of the fourth horizontal movement link 304. The eighth connection 408 is connected to be rotatable with respect to the seventh connection 407 based on a $24^{th}$ rotary shaft ("a second basic rotary shaft") 524. Therefore, the fourth horizontal movement link 304 is rotatable with respect to the third horizontal movement link 303 based on the $24^{th}$ rotary shaft 524.

A second connection 402 is formed at the other end of the fourth horizontal movement link 304, and the second connection 402 is fixed to the motor shaft 334 of the second motor 332 to be rotatable based on the $16^{th}$ rotary shaft 516 by means of the rotation of the motor shaft 334 of the second motor 332. Accordingly, the fourth horizontal movement link 304 is rotatable based on the $16^{th}$ rotary shaft 516.

Figure 13:
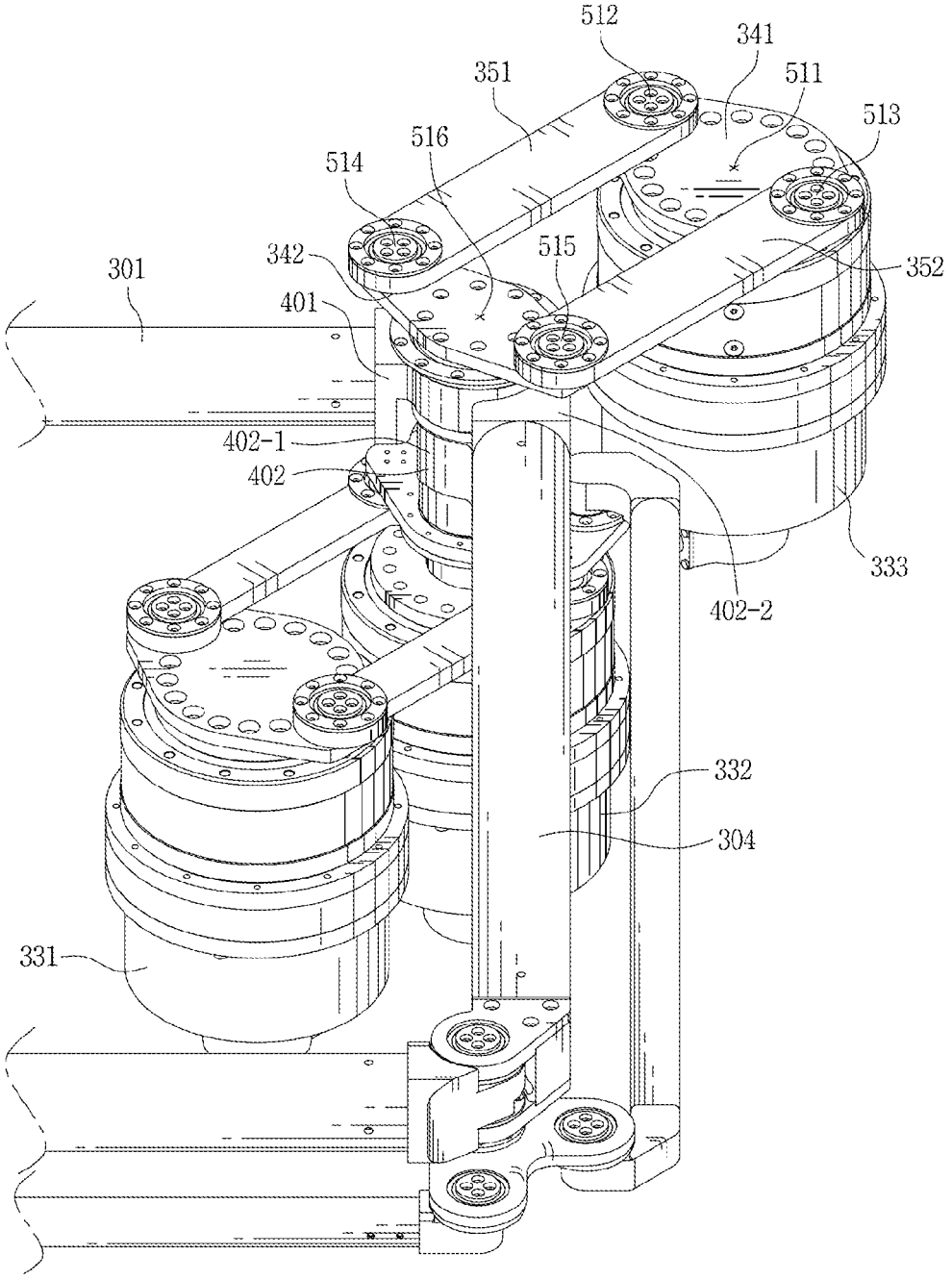
FIG. 13 is an enlarged view showing connection portions of a first horizontal movement link and a fourth horizontal movement link.

FIG. 13 is an enlarged view showing connection portions of a first horizontal movement link 301 and a fourth horizontal movement link 304.

As shown in FIG. 13, the second connection 402 formed at the end of the fourth horizontal movement link 304 includes a shaft coupling unit 402-1 disposed below the first connection 401 and fixedly coupled to the motor shaft 334 of the second motor 332, and a link coupling unit 402-2 extending vertically from one side of the shaft coupling unit 402-1. The shaft coupling unit 402-1 and the link coupling unit 402-2 are integrally formed.

The fourth horizontal movement link 304 is coupled to a top end of the link coupling unit 402-2, and the first horizontal movement link 301 and the fourth horizontal movement link 304 extend at the same height from the ground.

Meanwhile, a sixth rotation cam 342 fixedly coupled to the first connection 401 is formed at a top end of the first connection 401 of the first horizontal movement link 301. The sixth rotation cam 342 is rotatable based on the $16^{th}$ rotary shaft 516.

A $14^{th}$ rotary shaft 514 and a $15^{th}$ rotary shaft 515 are formed symmetrically based on the $16^{th}$ rotary shaft 516 which is a rotation center of the sixth rotation cam 342.

Meanwhile, a fifth rotation cam 341 is fixedly coupled to a motor shaft (not shown) of the first motor 333. As the motor shaft (not shown) of the first motor 333 rotates, the fifth rotation cam 341 rotates based on an $11^{th}$ rotary shaft 511 which is a rotation center of the motor shaft. A $12^{th}$ rotary shaft 512 and a $13^{th}$ rotary shaft 513 are formed symmetrically based on the $11^{th}$ rotary shaft 511 which is a rotation center of the fifth rotation cam 341.

A first connection bar 351 and a second connection bar 352 are formed between the fifth rotation cam 341 and the sixth rotation cam 342.

One end of the first connection bar 351 is connected to be rotatable with respect to the sixth rotation cam 342 based on the $14^{th}$ rotary shaft 514, and the other end of the first connection bar 351 is connected to be rotatable with respect to the fifth rotation cam 341 based on the $12^{th}$ rotary shaft 512. One end of the second connection bar 352 is connected to be rotatable with respect to the sixth rotation cam 342 based on the $15^{th}$ rotary shaft 515, and the other end of the second connection bar 352 is connected to be rotatable with respect to the fifth rotation cam 341 based on the $13^{th}$ rotary shaft 513.

In this configuration, if the motor shaft of the first motor 333 rotates, the fifth rotation cam 341 rotates based on the $11^{th}$ rotary shaft 511. For example, if the fifth rotation cam 341 rotates in a clockwise direction, the fifth rotation cam 341 pulls the first connection bar 351 and pulls the second connection bar 352 (see FIG. 15A).

Due to the change of locations of the first connection bar and the second connection bar, the sixth rotation cam 342 rotates in a clockwise direction.

If the sixth rotation cam 342 rotates in a clockwise direction, the first connection 401 rotates as much as its rotation angle, and the first horizontal movement link 301 rotates in a clockwise direction based on the $16^{th}$ rotary shaft 516.

At this time, since the first connection 401 is connected to be freely rotatable with respect to the motor shaft 334 of the second motor 332, a rotation force of the first horizontal movement link 301 is not applied to the motor shaft 334 of the second motor 332.

Meanwhile, if the motor shaft 334 of the second motor 332 is controlled to rotate in a counterclockwise direction separately from the operation of the first motor 333, the second connection 402 fixedly coupled to the motor shaft of the second motor 332 rotates in a counterclockwise direction. By doing so, the fourth horizontal movement link 304 coupled to the second connection 402 rotates in a counterclockwise direction based on the $16^{th}$ rotary shaft 516.

Referring to FIGS. 10 and 11 again, the third link unit 32 includes first to fourth rotation links 311, 312, 313, 314 arranged approximately parallel to the four horizontal movement links of the second link unit 31.

Figure 14:
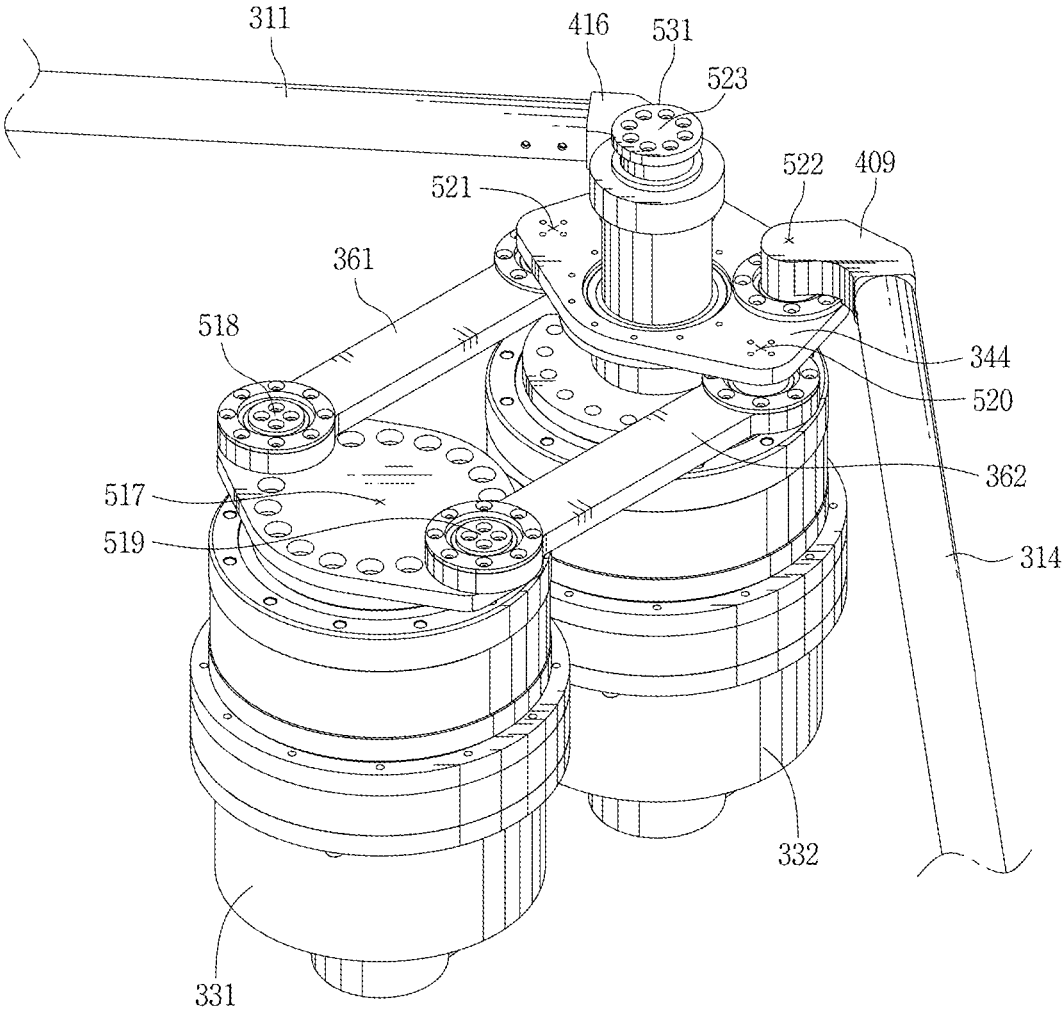
FIG. 14 is an enlarged view showing connection portions of a first rotation link of a third link unit and a connection portion of a fourth rotation link.

FIG. 14 is an enlarged view showing connection portions of a first rotation link 311 of a third link unit 32 and a connection portion of a fourth rotation link 314.

As shown in FIG. 14, a seventh rotation cam 343 is fixedly coupled to a motor shaft (not shown) of a third motor 331. Due to the rotation of the motor shaft of the third motor 331, the seventh rotation cam 343 may rotate based on the $17^{th}$ rotary shaft 517.

An $18^{th}$ rotary shaft 518 and a $19^{th}$ rotary shaft 519 are formed symmetrically based on the $17^{th}$ rotary shaft 517 which is a rotation center of the seventh rotation cam 343.

Meanwhile, a fourth rotation cam 344 is fixed to the motor shaft 334 of the second motor 332 to be freely rotatable. A $21^{st}$ rotary shaft 521 and a $20^{th}$ rotary shaft 520 are formed symmetrically based on the $23^{rd}$ rotary shaft 523 which is a rotation center of the fourth rotation cam 344.

A third connection bar 361 and a fourth connection bar 362 are formed between the seventh rotation cam 343 and the fourth rotation cam 344.

One end of the third connection bar 361 is connected to be rotatable based on the $18^{th}$ rotary shaft 518 with respect to the seventh rotation cam 343, and the other end of the third connection bar 361 is connected to be rotatable based on $21^{st}$ rotary shaft 521 with respect to the fourth rotation cam 344. One end of the fourth connection bar 362 is connected to be rotatable based on the $19^{th}$ rotary shaft 519 with respect to the seventh rotation cam 343, and the other end of the fourth connection bar 362 is connected to be rotatable based on the $20^{th}$ rotary shaft 520 with respect to the fourth rotation cam 344.

The third connection bar 361 and the fourth connection bar 362 are connected to the fourth rotation cam 344 at a lower surface of the fourth rotation cam 344 so that the third connection bar 361 and the fourth connection bar 362 do not interfere operations of the first horizontal movement link 301 and the fourth horizontal movement link 304.

If the motor shaft of the third motor 331 rotates, the seventh rotation cam 343 rotates based on the $17^{th}$ rotary shaft 517. For example, if the seventh rotation cam 343 rotates in a clockwise direction, the seventh rotation cam 343 pushes the third connection bar 361 and pushes the fourth connection bar 362. Due to the change of locations of the third connection bar and the fourth connection bar, the fourth rotation cam 344 rotates in a clockwise direction.

Meanwhile, a $16^{th}$ connection 416 having approximately an "L" shape is formed at one end of the first rotation link 311. One end of the $16^{th}$ connection 416 is connected to be rotatable based on a $31^{st}$ rotary shaft 531 with respect to the fourth rotation cam 344, and the first rotation link 311 extends from the other end of the $16^{th}$ connection 416. The $31^{st}$ rotary shaft 531 is formed at the rear in comparison to the $21^{st}$ rotary shaft 521.

A ninth connection 409 having the same shape as the $16^{th}$ connection 416 is formed at one end of the fourth rotation link 314. One end of the ninth connection 409 is connected to be rotatable based on a $22^{nd}$ rotary shaft 522 with respect to the fourth rotation cam 344, and the fourth rotation link 314 extends from the other end of the ninth connection 409. The $22^{nd}$ rotary shaft 522 is formed at the rear in comparison to the $20^{th}$ rotary shaft 520.

If the fourth rotation cam 344 rotates in a clockwise direction based on the $23^{rd}$ rotary shaft 523, the first rotation link 311 is pulled rearwards, and simultaneously, the fourth rotation link 314 is pushed forwards.

Referring to FIGS. 10 and 11 again, the third rotation cam 323 is formed at a connection portion of the first horizontal movement link 301 and the second horizontal movement link 302. In addition, the first rotation cam 322 is formed at a connection portion of the second horizontal movement link 302 and the third horizontal movement link 303. In addition, the second rotation cam 321 is formed at a connection portion of the third horizontal movement link 303 and the fourth horizontal movement link 304.

Since the first to third rotation cams 321, 322, 323 have the same structure, the structure of the first rotation cam 322 will be explained representatively with reference to FIG. 12. The first rotation cam 322 is composed of a horizontal plate 322-1 parallel to the ground and having approximately a "V" shape, and a vertical rod 322-2 extending perpendicular to the horizontal plate 322-1.

The vertical rod 322-2 is disposed so that its central axis has the same axis as the rotary shaft 527 defined by the second horizontal movement link 302 and the third horizontal movement link 303. In this embodiment, the centers O' of the rotary shaft 527 and the driving bunch 324 form the same axis.

The fifth connection 405 of the second horizontal movement link 302 and the sixth connection 406 of the third horizontal movement link 303, coupled to be rotatable with respect to each other, are connected to the vertical rod 322-2 to be freely rotatable with respect to the vertical rod 322-2.

The driving bunch 324 is fixedly coupled to the vertical rod 322-2. Therefore, if the first rotation cam 322 rotates based on the rotary shaft 527, the driving bunch 324 rotates based on its center O'. If the driving bunch 324 rotates based on the center O', the connector 110 rotates based on the center O'.

Meanwhile, the second rotation link 312 and the third rotation link 313 are respectively connected to both ends of the first rotation cam 322 disposed at the outer side of the rotary shaft 527.

The $13^{th}$ connection 413 formed at one end of the second rotation link 312 is connected to be rotatable based on the $28^{th}$ rotary shaft 528 with respect to the first rotation cam 322. The $12^{th}$ connection 412 formed at one end of the third rotation link 313 is connected to be rotatable based on the $29^{th}$ rotary shaft 529 with respect to the first rotation cam 322.

Referring to FIGS. 10 and 11, the third rotation cam 323 also includes a horizontal plate having approximately a "V" shape and a vertical rod extending perpendicular to the horizontal plate.

A central axis of the vertical rod of the third rotation cam 323 is disposed on the same axis as the $30^{th}$ rotary shaft 530 defined by the first horizontal movement link 301 and the second horizontal movement link 302.

The third connection 403 of the first horizontal movement link 301 and the fourth connection 404 of the second horizontal movement link 302, coupled to be rotatable with respect to each other, are connected to be freely rotatable with respect to the vertical rod of the third rotation cam 323.

Meanwhile, the first rotation link 311 and the second rotation link 312 are respectively connected to both ends of the first rotation cam 321 disposed at an outer side of the $30^{th}$ rotary shaft 530.

A $15^{th}$ connection 415 formed at one end of the first rotation link 311 has a bent shape approximately with an "L" shape and is connected to be rotatable based on the $32^{nd}$ rotary shaft 532 with respect to the third rotation cam 323. The $14^{th}$ connection 414 formed at one end of the second rotation link 312 is connected to be rotatable based on the $31^{st}$ rotary shaft 531 with respect to the third rotation cam 323.

The second rotation cam 321 also includes a horizontal plate having approximately a "V" shape and a vertical rod extending perpendicular to the horizontal plate.

A central axis of the vertical rod of the second rotation cam 321 is disposed on the same axis as the $24^{th}$ rotary shaft 524 defined by the fourth horizontal movement link 304 and the third horizontal movement link 303.

The seventh connection 407 of the third horizontal movement link 303 and the eighth connection 408 of the fourth horizontal movement link 304, coupled to be rotatable with respect to each other, are connected to be freely rotatable with respect to the vertical rod of the second rotation cam 321.

Meanwhile, the third rotation link 313 and the fourth rotation link 314 are respectively connected to both ends of the second rotation cam 321 disposed at an outer side of the $24^{th}$ rotary shaft 524.

A tenth connection 410 formed at one end of the fourth rotation link 314 has a bent shape approximately with an "L" shape and is connected to be rotatable based on the $26^{th}$ rotary shaft 526 with respect to the second rotation cam 321. The $11^{th}$ connection 411 at one end of the third rotation link 313 is connected to be rotatable based on the $25^{th}$ rotary shaft 525 with respect to the second rotation cam 321.

As well shown in FIG. 11, connections at both ends of the first rotation link 311 and the fourth rotation link 314 are bent into approximately an "L" shape, and thus the first rotation link 311 and the fourth rotation link 314 are disposed farther from the corresponding horizontal movement links, in comparison to the second rotation link 312 and the third rotation link 313.

Figure 15A:
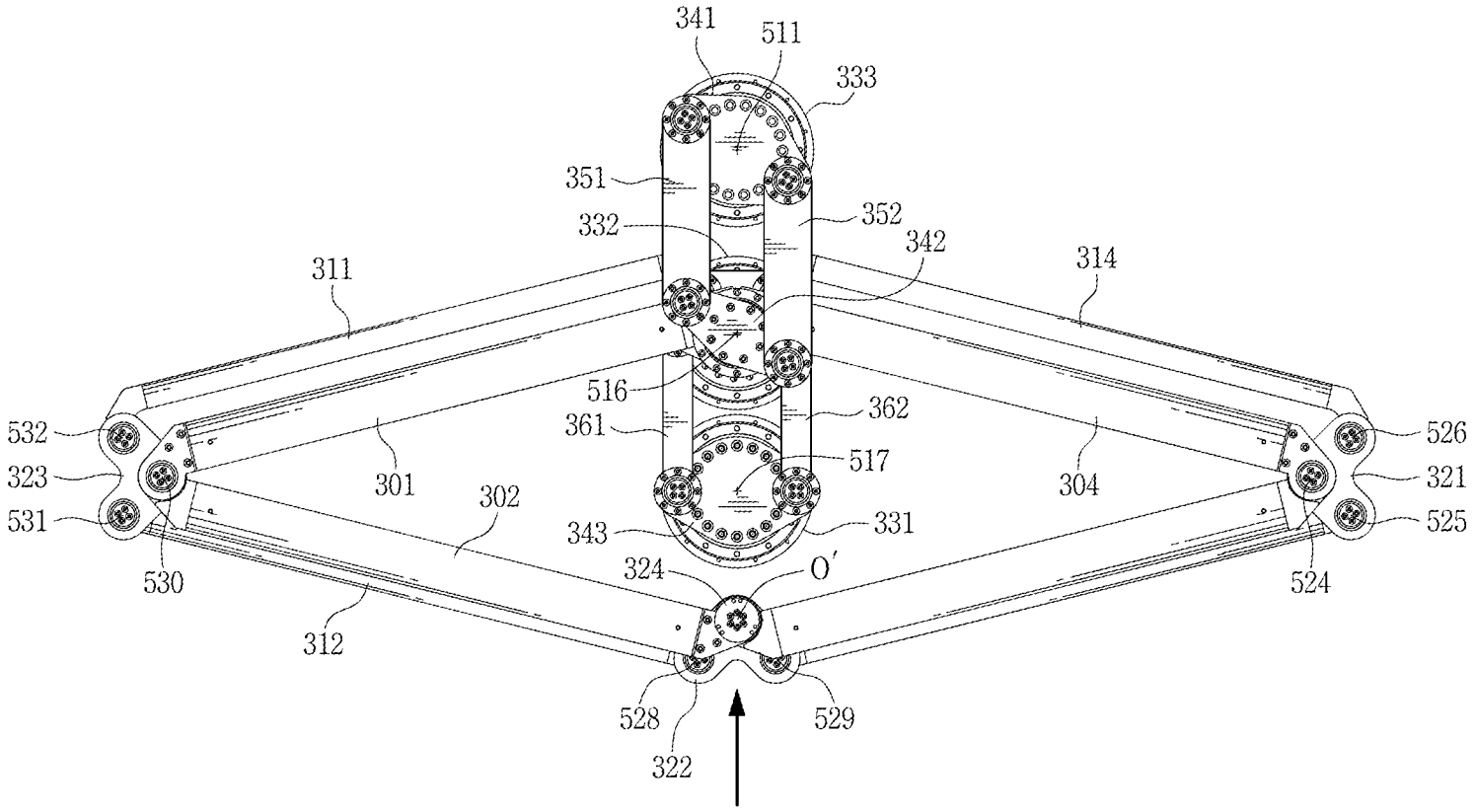
FIGS. 15A and 15B are diagrams showing that the driving bunch is moved horizontally.
Figure 15B:
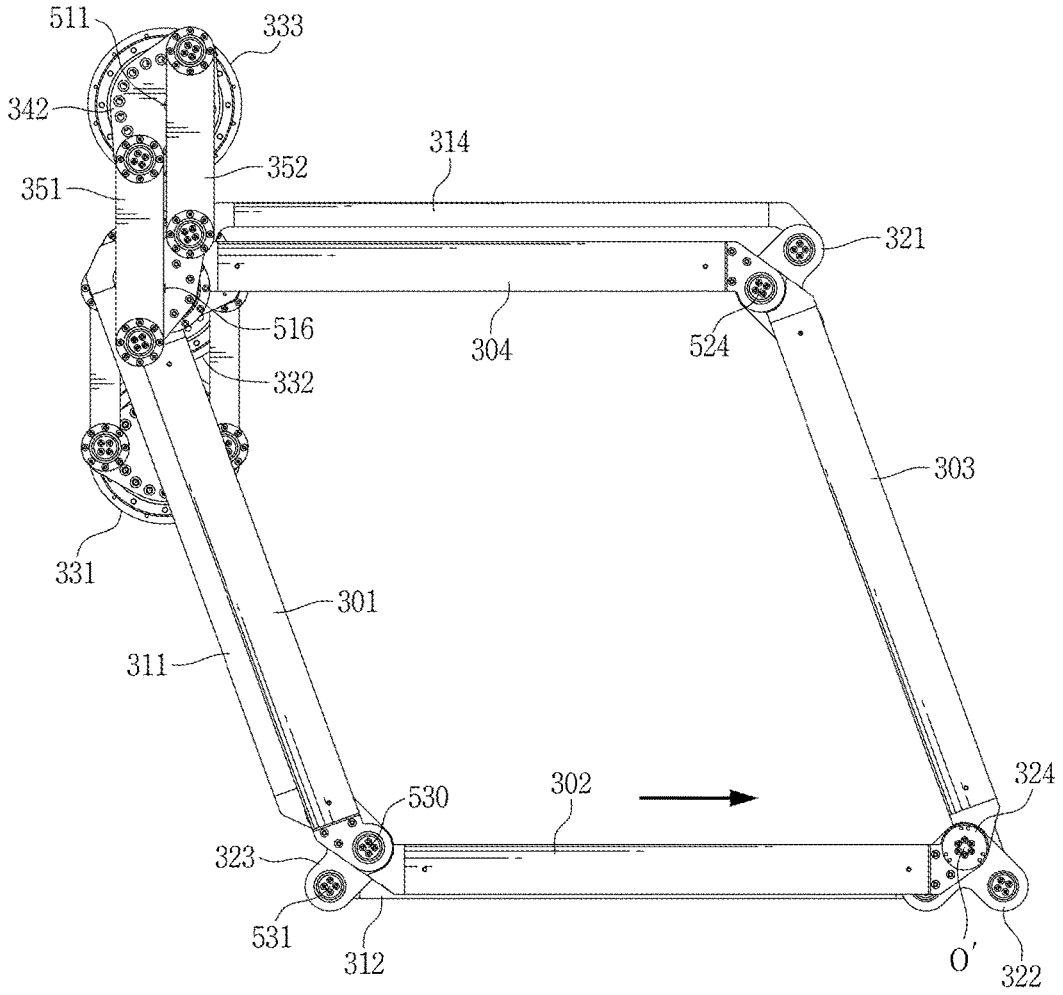

FIGS. 15A and 15B are diagrams showing that the driving bunch 324 is moved horizontally by operating the second link unit 21.

FIG. 15A is a diagram for illustrating forward and rearward horizontal movement of the driving bunch 324.

As shown in FIG. 15A, the motor shaft 334 of the second motor 332 is rotated in a counterclockwise direction. The fourth horizontal movement link 304 rotates in a counterclockwise direction as much as a rotation angle of the second motor 332.

Simultaneously, the motor shaft of the first motor 333 is rotated in a clockwise direction as much as the same rotation angle. The rotation force of the first motor 333 causes rotation of the fifth rotation cam 341, and the rotation of the fifth rotation cam 341 is transferred through the connection bars 351, 352 to the sixth rotation cam 342, thereby rotating the first horizontal movement link 304 in a clockwise direction.

By means of successive kinetic movements of the second link unit 21 which is a four-node link body, the clockwise rotation of the first horizontal movement link 301 causes counterclockwise rotation of the second horizontal movement link 302 based on the $30^{th}$ rotary shaft 530. In addition, the counterclockwise rotation of the fourth horizontal movement link 304 causes clockwise rotation of the third horizontal movement link 303 based on the $24^{th}$ rotary shaft 524.

Therefore, as shown in FIG. 15A, the driving bunch 324 formed at the connection portion of the second horizontal movement link 302 and the third horizontal movement link 303 makes horizontal movement (rearward horizontal movement) in an arrow direction.

On the contrary, if the motor shaft 334 of the second motor 332 is rotated in a clockwise direction and the motor shaft of the first motor 333 is rotated in a counterclockwise direction as much as the same rotation angle, it would be understood that the driving bunch 324 makes forward horizontal movement.

FIG. 15B is a diagram for illustrating right and left horizontal movement of the driving bunch 324.

As shown in FIG. 15B, the motor shaft 334 of the second motor 332 is rotated in a counterclockwise direction. The fourth horizontal movement link 304 rotates in a counterclockwise as much as the rotation angle of the direction second motor 332.

Simultaneously, the motor shaft of the first motor 333 is rotated in a counterclockwise direction. The rotation force of the first motor 333 causes rotation of the fifth rotation cam 341, and the rotation of the fifth rotation cam 341 is transferred through the connection bars 351, 352 to the sixth rotation cam 342, thereby rotating the first horizontal movement link 304 in a counterclockwise direction.

By means of successive kinetic movements of the second link unit 31 which is a four-node link body, the above rotation of the first horizontal movement link 301 and the fourth horizontal movement link 304 causes relative rotations of the second and third horizontal movement links 302, 303, thereby moving the driving bunch 324 horizontally to the right in an arrow direction.

On the contrary, if the motor shaft 334 of the second motor 332 is rotated in a clockwise direction and the motor shaft of the first motor 333 is rotated in a clockwise direction as much as the same rotation angle, it would be understood that the driving bunch 324 makes horizontal movement to the left.

In addition, if the rotation angles and the rotation directions of the second motor 332 and the first motor 333 are suitably combined, it may also be understood that the driving bunch 324 may freely move horizontally in a front, rear, right or left direction as long as such a movement is allowed by the kinetic structure of the second link unit 31.

The rotation angles and the rotation directions of the second motor 332 and the first motor 333 may be obtained by computing lengths and relative locations of the links of the second link unit 31 based on the location of the driving bunch 324.

Meanwhile, referring to FIGS. 15A and 15B, the third link unit 32 is coupled to the second link unit 31. However, even though the second link unit 31 moves, as long as the third motor 331 does not move, the first to third rotation cams 321, 322, 323 are formed to keep their postures without rotating with respect to each other. This is because the third link unit 32 is disposed at an outer side of the second link unit 31 due to the rotation cams 321, 322, 323 which may rotate relative to the horizontal movement link.

The rotation cams 321, 322, 323 do not rotate even though the second link unit 31 moves, and this means that the driving bunch 324 does not rotate based on its center O' even though the second link unit 31 moves.

Therefore, in this embodiment, even though the second link unit 31 and the third link unit 32 are coupled to each other, the second link unit 31 and the third link unit 32 are controlled independently and thus the processes of horizontally moving and rotating the driving bunch 324 are performed independently.

Figure 16:
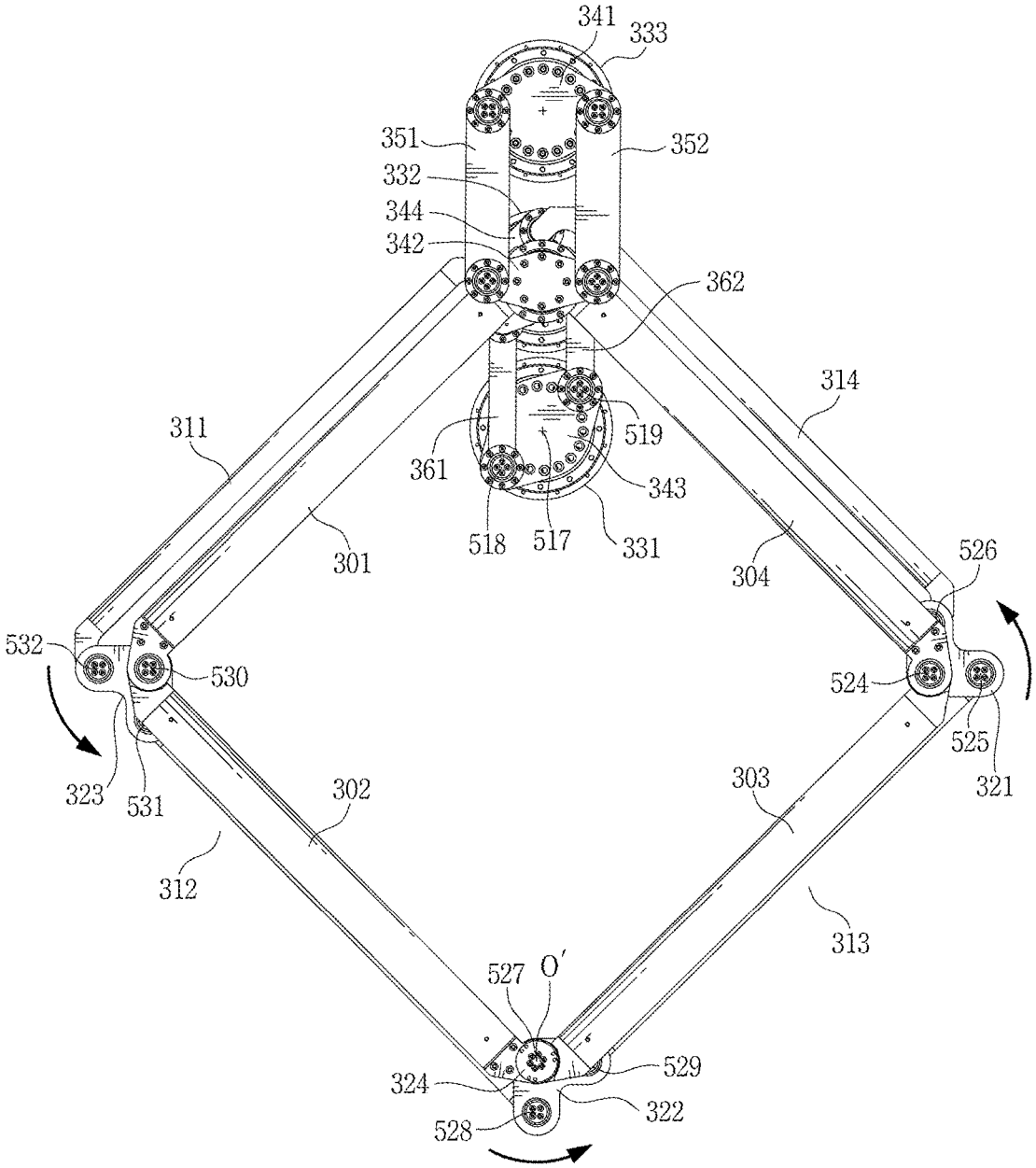
FIG. 16 is a diagram showing that the driving bunch is rotated.

FIG. 16 is a diagram showing that the driving bunch 324 is rotated based on its center O'.

As shown in FIG. 16, if the third motor 331 rotates in a counterclockwise direction, the seventh rotation cam 343 rotates in a counterclockwise direction. Due to the connection bars 361, 362, the rotation of the seventh rotation cam 343 causes the fourth rotation cam 344 to rotate in a counterclockwise direction.

The fourth rotation cam 344 pushes the first rotation link 311 while rotating, and the movement of the first rotation link 311 allows the third rotation cam 323 to rotate based on the $30^{th}$ rotary shaft 530.

The third rotation cam 323 pushes the second rotation link 312 while rotating, and the movement of the second rotation link 312 allows the second rotation cam 322 to rotate in a counterclockwise direction.

Regarding the rotation of the second rotation cam 322, it would be possible to explain that the fourth rotation cam 344 pulls the fourth rotation link 314 while rotating and thus successively causes rotation of the first rotation cam 321 and the second rotation cam 322.

The first to third rotation cams do not rotate in order but rotate simultaneously due to the rotation of the fourth rotation cam 344.

Since the driving bunch 324 is fixedly coupled to the second rotation cam 322, as the second rotation cam 322 rotates, the driving bunch 324 rotates based on its center O'.

It may be understood that the horizontal movement and rotation of the driving bunch 324 as described above may be performed simultaneously by operating the third motor 331 and the first and second motors 333, 332 together.

The horizontal movement and rotation of the driving bunch 324 causes horizontal movement and rotation of the connector 110 fixedly coupled thereto.

Figure 17:
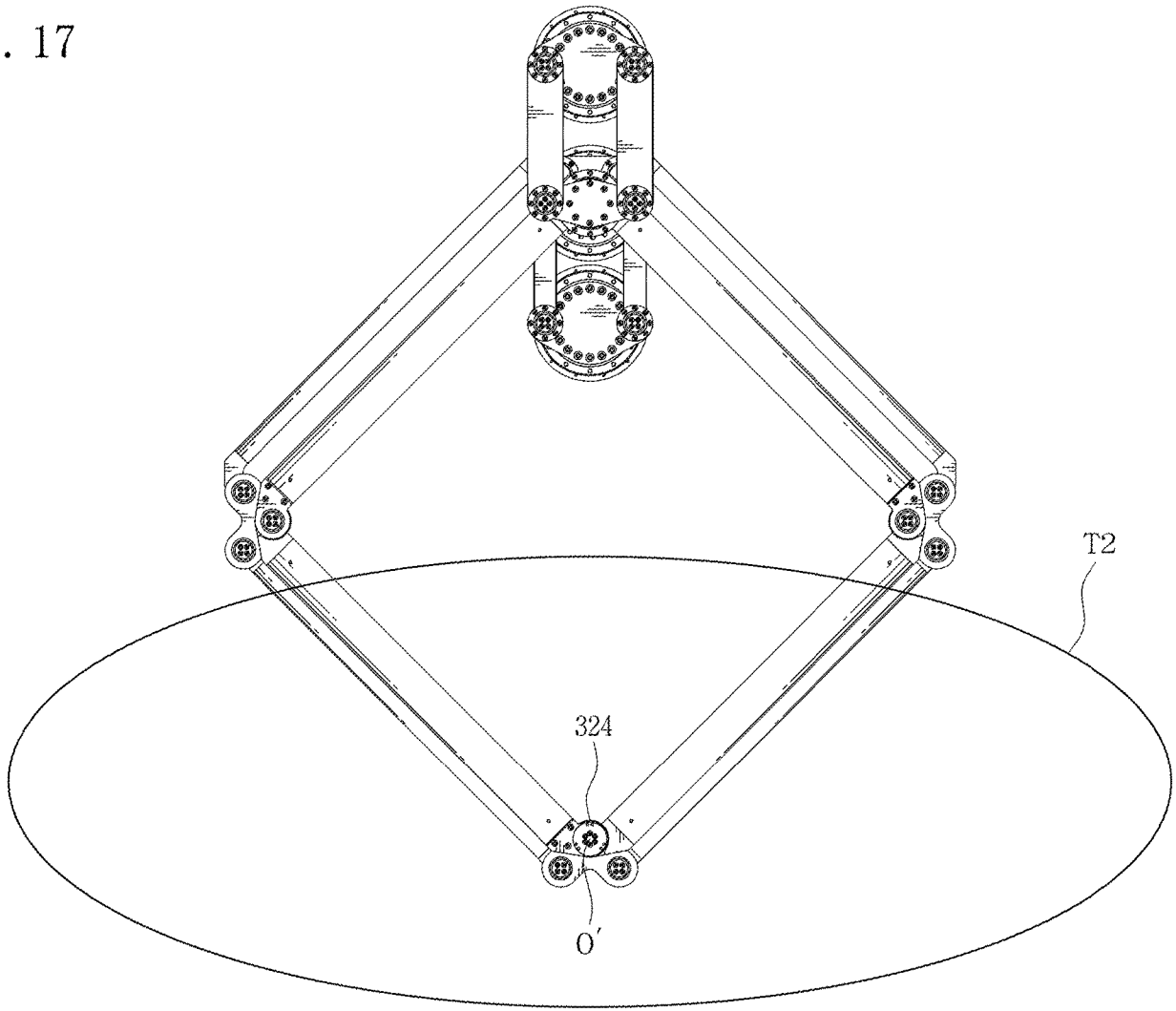
FIG. 17 is a diagram showing a work space in which the driving bunch is horizontally movable.

FIG. 17 is a diagram showing a work space T2 in which the driving bunch 324 (the connector 110) is horizontally movable.

The work space T2 depicted in FIG. 17 does not indicate an entire area in which the driving bunch 324 is movable but indicates an area in which the hand 3 may be located when the user U moves the arm 2 by using his/her shoulder.

According to this embodiment, the entire area in which the driving bunch 324 is movable may entirely cover an area T2 in which a human hand may be located.

As described above, a work space T1 in which a user may move the placing unit 101 with respect to the connector 110 is very narrow.

Therefore, in this embodiment, if the user places the arm on the placing unit 101 and moves the placing unit 101, the driving unit 30 is operated to move the connector 110 along the placing unit 101, so that an area in which the user may move the arm is enlarged to a broader work space T2 as shown in FIG. 17.

For this, a moved state of the placing unit 101 with respect to the connector 110 (namely, a moved state of the connection bunch 130 with respect to the connection body 110) is measured, and three motors 331, 332, 333 are controlled based on the measured value.

At a reference location, the connection bunch 130 is located at the center of the connector 110. The center of the connector 110 is located at the same axis as the center O' of the driving bunch 324. Therefore, at an initial state, the center O of the connection bunch 130 and the center O' of the driving bunch 324 are disposed on a straight line perpendicular to the ground. At the reference location, the first connection link body 140 and the second connection link body 150 of the first link unit 120 are disposed perfectly symmetrical to each other, and thus the connection bunch 130 is located not to rotate.

An angle of each connection link of the first link unit 120 for locating the connection bunch 130 at the reference location is measured, computed and stored by an angle sensor.

If the user moves the placing unit 101 so that the connection bunch 130 deviates from the reference location, the driving unit 30 is operated. At this time, the connection bunch 130 deviates from the reference location not only when the connection bunch 130 moves horizontally but also when the connection bunch 130 rotates at its place.

As described above, a location of the connection bunch 130 may be computed using a measurement value of the angle sensor.

The driving unit 30 is operated to move the center O' of the driving bunch 324 to a location of the center O of the connection bunch 130. In other words, the driving unit 30 moves the driving bunch 324 so that the location of the center O' of the driving bunch 324 follows the location of the center O of the connection bunch 130.

For example, when the connection bunch 130 moves horizontally in a left and rear direction, the driving unit 30 moves the driving bunch 324 horizontally in a left and rear direction. At this time, since the driving unit 30 moves the driving bunch 324 so that the location of the center O' of the driving bunch 324 follows the location of the center O of the connection bunch 130, when the user gives a force to move the connection bunch 130 faster, the driving bunch 324 is also moved faster.

Accordingly, the placing unit 101 fixedly coupled to the connection bunch 130 and the connector 110 fixedly coupled to the driving bunch 324 are horizontally moved in substantially the same direction at substantially the same speed.

Therefore, it is substantially always maintained that the connector 110 is located below the placing unit 101, and the work space in which the user U is able to move the arm may be enlarged as much as the work space T2 of the connector 110 provided by the driving unit 30 (see FIG. 17).

At this time, when moving the placing unit 101 with respect to the connector 110, the user U may perform rehabilitation training while feeling just very small resistance applied by the first link unit 120.

Meanwhile, for example, if the user turns the wrist to rotate the placing unit 101 (the connection bunch 130), the driving unit 30 rotates driving bunch 324 based on its center O'.

Due to the rotation of the driving bunch 324, the connector 110 rotates, and the rotation of the connector 110 enlarges a rotation angle at which the placing unit 101 may rotate at its place.

The driving unit 30 stops its operation if the connection bunch 130 returns to the reference location again.

As described above, the driving unit 30 is operated when the placing unit 101 (the connection bunch 130) deviates from the reference location defined with reference to the connector 110, and if the connector 110 is controlled to move the placing unit 101 to be placed at the reference location, the driving unit 30 quickly responds to the movement of the placing unit 101.

However, the method for controlling the driving unit 30 is not limited thereto.

As shown in FIG. 7, a movement area T1' of the placing unit 101 (the connection bunch 130), which is smaller than the entire work space T1 in which the connection bunch 130 is movable with respect to the connector 110, may be defined. If the placing unit 101 moves to deviate from the movement area T1', the driving unit 30 may move the connector 110 (the driving bunch 324) so that the placing unit 101 is located in the movement area T1' again.

In this case, when the connection bunch 130 is located in the movement area T1', the driving unit 30 is not operated, but at the instant that the center O of the connection bunch 130 deviates from a boundary of the movement area T1', the driving unit 30 is operated to move the connector 110 so that relative locations of the placing unit 101 and the connector 110 are suitably maintained, thereby enlarging the work space in which the arm is movable.

Here, the movement area T1' does not always represent only a range in which the connection bunch 130 moves horizontally but may also represent a rotation angle smaller than a maximum rotation angle in which the connection bunch 130 is rotatable.

Meanwhile, in this embodiment, only an active rehabilitation exercise which requires the user to directly move the placing unit has been described, but the present disclosure is not limited thereto.

For example, the location of the placing unit 101 with respect to the connector 110 is fixed using the brake units 181, 182, 191, 192, and the driving unit 30 is operated to move the connector 110, so that the arm of a patient who cannot use the arm by himself/herself can be trained.

Meanwhile, in this embodiment, a moving situation of the placing unit 101 may be visually provided to the user U by using the display unit 60. In addition, a rehabilitation program in which the user may designate a moving path of the placing unit 101 so that the arm is guided to move along the corresponding moving path for rehabilitation training may be demonstrated using the display unit 60.

Figure 18:
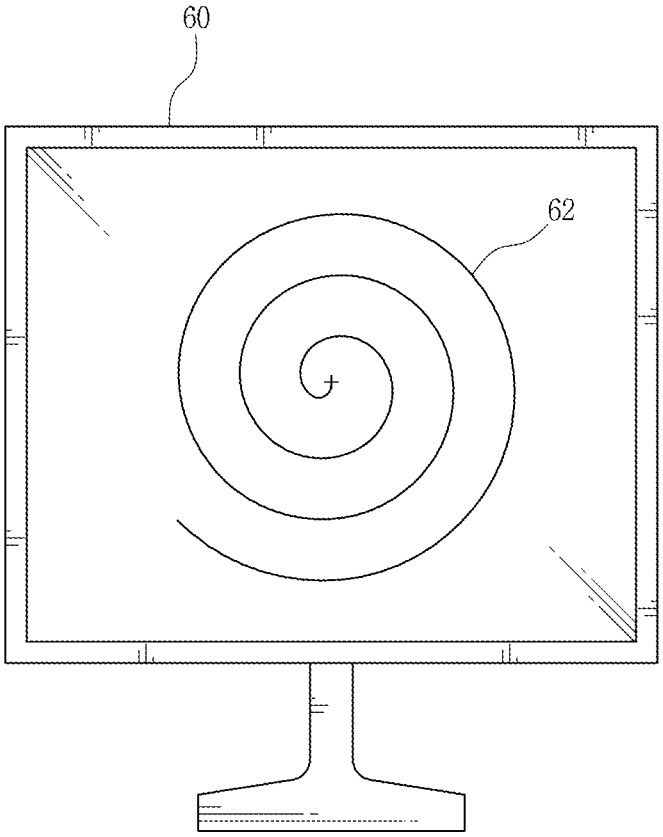
FIGS. 18 and 19 are diagrams showing an example of a rehabilitation program.
Figure 19:
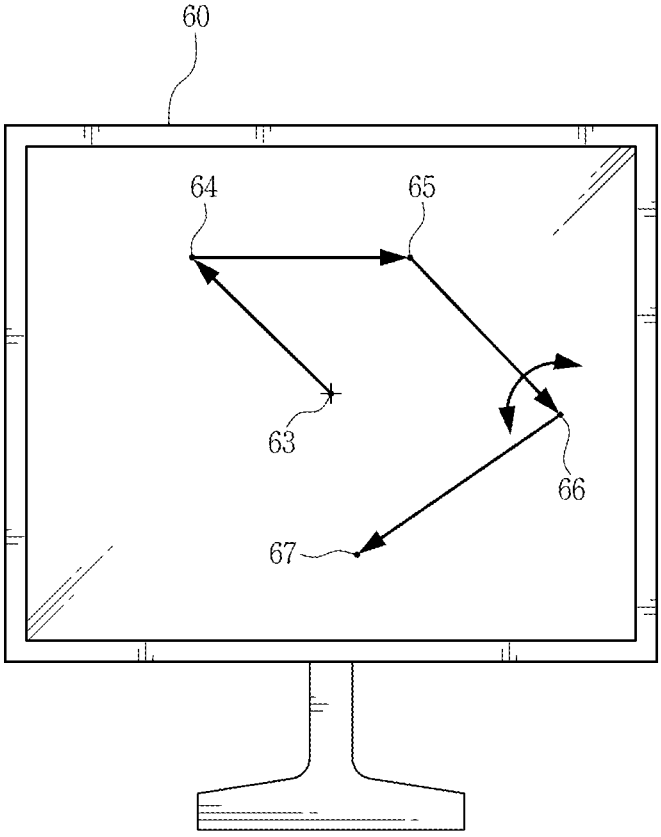

FIGS. 18 and 19 are diagrams showing an example of a rehabilitation program.

As shown in FIG. 18, for example, a path 62 having a whirlwind shape may be provided to the user U by means of the display unit 60.

A location of the placing unit 101 (namely, a location of the hand of the user) is displayed with a cross mark, and the user is instructed to move the placing unit 101 by moving the arm so that the cross mark moves along the path 62. The result showing how successfully the cross mark moves along the path 62 may be provided by means of the display unit 60.

In addition, as shown in FIG. 19, a linear/curved moving path may be provided to the user U by means of the display unit 60.

The user is instructed to move the placing unit 101 straightly from a start point 63 to next points 64, 65, 66 by using the arm, then rotate the placing unit 101 at the point 66 by using the wrist, and then straightly move the placing unit 101 to a final point.

As described above, various training programs for horizontally moving or rotating the placing unit 101 may be provided to the user for effective rehabilitation training.

According to this embodiment, the user may move the arm while just feeling resistance of only the first link unit 120 having a passive joint, which minimizes the force required for operating the rehabilitation device. Meanwhile, since the placing unit and the connector which should be moved by the user are movable with respect to each other and the connector is moved by means of the link units using motors, the work space for performing operations required for upper-limb rehabilitation may be maximized.

Even though the device for upper-limb rehabilitation which is used for rehabilitation of the arm of the user has been described in the specification, it may be understood that this device may be modified as a device for lower-limb rehabilitation, for rehabilitating the legs, by installing the placing unit and associated links near the ground. In other words, any configuration for the lower limb of a user and lower-limb rehabilitation training may fall within the equivalent scope of the present disclosure.

What is claimed is:

1. A device for upper-limb rehabilitation, comprising:
- a connector;
- a placing unit movably connected to the connector; and
- a driving unit comprising
  - a driving bunch coupled to the connector,
  - a first link unit comprising first to fourth horizontal movement links and configured to translationally move the driving bunch, and
  - a second link unit comprising first to fourth rotation links and configured to rotate the driving bunch about an axis of the driving bunch,
- wherein the driving unit is configured to move the connector along the placing unit, in response to an arm moving the placing unit, and move the connector so that the connector rotates based on a center of the connector, in response to the placing unit rotating about a center of the placing unit.

2. The device for upper-limb rehabilitation according to claim 1, wherein the connector comprises
- a connection body connected to the driving unit,
- a connection bunch connected to the placing unit,
- a third link unit configured to fix the connection bunch to be movable with respect to the connection body, and
- angle sensors configured to measure rotation angles of links of the third link unit, and provide information about rotation and horizontal movement of the connection bunch.

3. The device for upper-limb rehabilitation according to claim 2,
- wherein the third link unit comprises a first connection link body and a second connection link body connected to different portions of the connection bunch to form a closed-loop structure between the connection bunch and the connection body.

4. The device for upper-limb rehabilitation according to claim 3,
- wherein the angle sensors are provided at a connection portion of the first connection link body and the second connection link body, which is connected to the connection body.

5. The device for upper-limb rehabilitation according to claim 2,
- wherein the connector further comprises a brake unit configured to interfere with an operation of the third link unit to adjust a resistance force of the placing unit.

6. The device for upper-limb rehabilitation according to claim 1,
- wherein the first link unit and the second link unit are coupled to each other and are independently controlled to horizontally move or rotate the driving bunch.

7. The device for upper-limb rehabilitation according to claim 6,
- wherein the first to fourth horizontal movement links are rotatably connected to form a closed-loop structure and define first to fourth basic rotary shafts on which the first to fourth horizontal movement links are rotatable relative to each other, and
- wherein the driving bunch is formed at a connection portion of the second horizontal movement link and the third horizontal movement link to horizontally move according to relative rotations of the first to fourth horizontal movement links.

8. The device for upper-limb rehabilitation according to claim 7, wherein the second link unit comprises first to fourth rotation cams rotatable about respective centers of the first to fourth basic rotary shafts, respectively, wherein the first to fourth rotation links are connected with the first to fourth rotation cams to form a closed-loop structure, and wherein the driving bunch is coupled to the first rotation cam to rotate about the center of the first basic rotary shaft according to the rotation of the first rotation cam.

9. The device for upper-limb rehabilitation according to claim 8, wherein a third motor is provided to rotate the fourth rotation cam about the center of the fourth basic rotary shaft, which faces the first rotation cam, and wherein the first rotation cam is configured to rotate about the first basic rotary shaft by means of successive operations of the first to fourth rotation links according to rotation of the fourth rotation cam.

10. The device for upper-limb rehabilitation according to claim 7, wherein a first motor and a second motor are configured to rotate the first horizontal movement link and the fourth horizontal movement link, which are formed to be rotatable based on the fourth basic rotary shaft which faces the first basic rotary shaft, with respect to the fourth basic rotary shaft.

11. The device for upper-limb rehabilitation according to claim 1, further comprising a display unit configured to visually display a movement situation of the placing unit.

12. The device for upper-limb rehabilitation according to claim 11, wherein the display unit is further configured to display a rehabilitation program to designate a movement path of the placing unit.

13. The device for upper-limb rehabilitation according to claim 1, wherein the driving unit is further configured to move the connector so that the placing unit is positioned at a reference location defined with respect to the connector, in response to the placing unit deviating from the reference location.

14. The device for upper-limb rehabilitation according to claim 1, wherein a movement area in which the placing unit is movable with respect to the connector is defined, and wherein the driving unit is further configured to move the connector so that the placing unit is located in the movement area, in response to the placing unit moving beyond the movement area.

15. The device for upper-limb rehabilitation according to claim 1, wherein a location of the placing unit with respect to the connector is fixed.

16. A device for upper-limb rehabilitation which is configured to assist a user in exercising an arm for rehabilitation, the device comprising:

a connector;

a placing unit movably connected to the connector; and a driving unit configured to move the connector, wherein when the user places the arm on the placing unit and moves the placing unit, the driving unit is operated to move the connector along the placing unit, so as to enlarge a work space in which the user is capable of moving the arm, wherein the driving unit comprises a driving bunch coupled to the connector, a first link unit configured to move the driving bunch horizontally, and a second link unit configured to rotate the driving bunch, wherein the first link unit and the second link unit are formed to be coupled to each other and are independently controlled to horizontally move or rotate the driving bunch independently, wherein the first link unit includes first to fourth horizontal movement links, wherein the first to fourth horizontal movement links are connected to form a closed-loop structure and define first to fourth basic rotary shafts on which the first to fourth horizontal movement links rotate relative to each other, wherein the driving bunch is formed at a connection portion of the second horizontal movement link and the third horizontal movement link, which define the first basic rotary shaft, to horizontally move according to relative rotations of the first to fourth horizontal movement links, wherein the second link unit comprises first to fourth rotation links, and first to fourth rotation cams configured to be rotatable based on centers of the first to fourth basic rotary shafts, respectively, wherein the first to fourth rotation links are connected with the first to fourth rotation cams being interposed therebetween to form a closed-loop structure, and wherein the driving bunch is coupled to the first rotation cam to rotate based on the center of the first basic rotary shaft according to the rotation of the first rotation cam.

17. A device for upper-limb rehabilitation, comprising:

rotary shafts;

rotation cams rotatably coupled to the rotary shafts;

a connector;

a placing unit movably connected to the connector; and a driving unit comprising a driving bunch coupled to the connector, a first link unit comprising first to fourth horizontal movement links and configured to translationally move the driving bunch, and a second link unit comprising first to fourth rotation links and configured to rotate the driving bunch about an axis of the driving bunch, wherein the first to fourth horizontal movement links are rotatably coupled to the rotary shafts to form a first quadrilateral, wherein the first to fourth rotation links are rotatably coupled to the rotation cams to form a second quadrilateral, and wherein the driving unit is configured to move the connector along the placing unit, in response to an arm moving the placing unit.

* * * * *